US007745713B2

(12) United States Patent
Fukada et al.

(10) Patent No.: US 7,745,713 B2
(45) Date of Patent: Jun. 29, 2010

(54) ELECTRONIC MUSICAL INSTRUMENT WITH DIRECT PRINT INTERFACE

(75) Inventors: Atsushi Fukada, Hamamatsu (JP); Shuji Yamamoto, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 11/690,162

(22) Filed: Mar. 23, 2007

(65) Prior Publication Data

US 2007/0227335 A1 Oct. 4, 2007

(30) Foreign Application Priority Data

Mar. 28, 2006 (JP) ..... 2006-086983
Mar. 28, 2006 (JP) ..... 2006-087084
Mar. 30, 2006 (JP) ..... 2006-094491

(51) Int. Cl.
*G10H 1/00* (2006.01)

(52) U.S. Cl. ..... 84/600; 84/477 R; 84/478

(58) Field of Classification Search ..... 84/477 R, 84/478, 600

See application file for complete search history.

(56) References Cited

U.S. PATENT DOCUMENTS 5,171,929 A * 12/1992 Usa ..... 84/615
5,461,191 A * 10/1995 Kondo et al. ..... 84/615
6,166,314 A * 12/2000 Weinstock et al. ..... 84/483.1
6,204,441 B1 * 3/2001 Asahi et al. ..... 84/470 R
6,225,545 B1 * 5/2001 Suzuki et al. ..... 84/477 R
6,303,852 B1 * 10/2001 Kizaki et al. ..... 84/622
6,642,444 B2 * 11/2003 Hagiwara et al. ..... 84/609
6,751,439 B2 * 6/2004 Tice et al. ..... 434/350
2001/0023633 A1 * 9/2001 Matsumoto ..... 84/478
2001/0037719 A1 * 11/2001 Gardner et al. ..... 84/478
2002/0002896 A1 * 1/2002 Hasegawa ..... 84/609
2002/0066357 A1 * 6/2002 Kosakaya et al. ..... 84/471 R
2002/0134216 A1 * 9/2002 Shibukawa ..... 84/477 R
2003/0110926 A1 * 6/2003 Sitrick et al. ..... 84/477 R (Continued)

FOREIGN PATENT DOCUMENTS

JP 2000-347661 A 12/2000

(Continued)

OTHER PUBLICATIONS

"White Paper of CIPA DC-001-2003 Digital Photo Solutions for Imaging Devices", Feb. 3, 2003, pp. 1-5, Camera & Imaging Products Association (cited in Present Application).

(Continued)

*Primary Examiner*—Walter Benson
*Assistant Examiner*—Kawing Chan
(74) *Attorney, Agent, or Firm*—Rossi, Kimms & McDowell LLP

(57) ABSTRACT

In an electronic musical instrument, an input device inputs performance information. A tone generator operates based on tone setting parameters for generating music sounds according to the performance information. A display is capable of switching a plurality of scenes for displaying either of the performance information or tone setting parameters. An image data generation part creates one or a plurality of print image data representing contents of the plurality of the scenes upon detecting a print instruction operation. An interface is provided in the electronic musical instrument to output the print image data directly to an external printer for printing out the contents of the scenes.

2 Claims, 26 Drawing Sheets

```
***LOG***
0001 : DETECTION DRIVER INITIALIZATION
0002 : DISPLAY DRIVER INITIALIZATION
...
(OMITTED)
...
0204 : PRINTER Configuration PROCESS
0205 : PRINTER GetCapability PROCESS
...
(OMITTED)
...
3728 : MIDI I/F RECEIVE "90 3C 70"
3729 : TONE GENERATION DRIVER PORT 1 WRITE "90 3C 70"
3730 : PERFORMANCE OPERATOR RECEIVE "90 4C 74"
3731 : TONE GENERATION DRIVER PORT 1 WRITE "90 4C 74"
...
(OMITTED)
...
4474 : SWITCH 1 TURNED ON
4475 : SWITCHED TO SONG MODE
4476 : SONG LIST DISPLAYED ON DISPLAY
...
(OMITTED)
...
***SETTING STATES***
```

| MODULE | DATA NAME | VALUE |
|---|---|---|
| TEMPO | TEMPO | 120 |
| SOUND MODULE | METRONOME | OFF |
| SOUND MODULE | MASTER TUNING | 00 |
| SOUND MODULE | TRANSPOSE | 00 |
| SOUND MODULE | DSP TYPE | 01 |
| SOUND MODULE | CONFIG. TABLE | 01 |
| SOUND MODULE | CUSTOM TABLE EDIT | ALL OFF |
| MIDI | I/O FILTER | ALL ON |
| KEYBOARD | VELOCITY FIX R | 110 |
| KEYBOARD | VELOCITY FIX L | 110 |
| KETBOARD | VELOCITY FIX ON/OFF L | OFF |
| KEYBOARD | VELOCITY FIX ON/OFF R | OFF |

```
...
(OMITTED)
...
```

U.S. PATENT DOCUMENTS

| | | | | |
|---|---|---|---|---|
| 2003/0150317 | A1 | 8/2003 | Hamilton | |
| 2003/0167903 | A1 | 9/2003 | Funaki | |
| 2004/0040433 | A1* | 3/2004 | Errico | 84/477 R |
| 2004/0112201 | A1* | 6/2004 | Funaki | 84/477 R |
| 2004/0144236 | A1 | 7/2004 | Hiratsuka | |
| 2004/0159212 | A1* | 8/2004 | Terada | 84/477 R |
| 2004/0161118 | A1* | 8/2004 | Chu | 381/61 |
| 2004/0221707 | A1 | 11/2004 | Hiratsuka et al. | |
| 2004/0221708 | A1* | 11/2004 | Hasegawa | 84/601 |
| 2004/0244567 | A1* | 12/2004 | Asakura | 84/613 |
| 2005/0243362 | A1 | 11/2005 | Sakuda et al. | |
| 2006/0039021 | A1* | 2/2006 | Kato et al. | 358/1.13 |
| 2007/0175316 | A1 | 8/2007 | Kumarova | |
| 2008/0037056 | A1 | 2/2008 | Tanimoto et al. | |

FOREIGN PATENT DOCUMENTS

| | | | |
|---|---|---|---|
| JP | 2003-333267 | A | 11/2003 |
| JP | 2004-069951 | A | 3/2004 |
| JP | 2004-117487 | A | 4/2004 |

OTHER PUBLICATIONS

Related co-pending U.S. Appl. No. 11/690,164; Atsushi, Fukada; "Electronic Musical Instrument with Direct Printer Interface"; filed Mar. 23, 2007; Spec. pp. 1-27; Figs. 1-6.

Notice of Reason for Rejection issued in corresponding Japanese Patent Application No. 2006-096691 dated Dec. 17, 2009. Cited in related co-pending U.S. Appl. No. 11/690,164.

Notice of Rejection issued in corresponding Japanese Patent Application No. 2006-087084 dated Apr. 13, 2010.

* cited by examiner

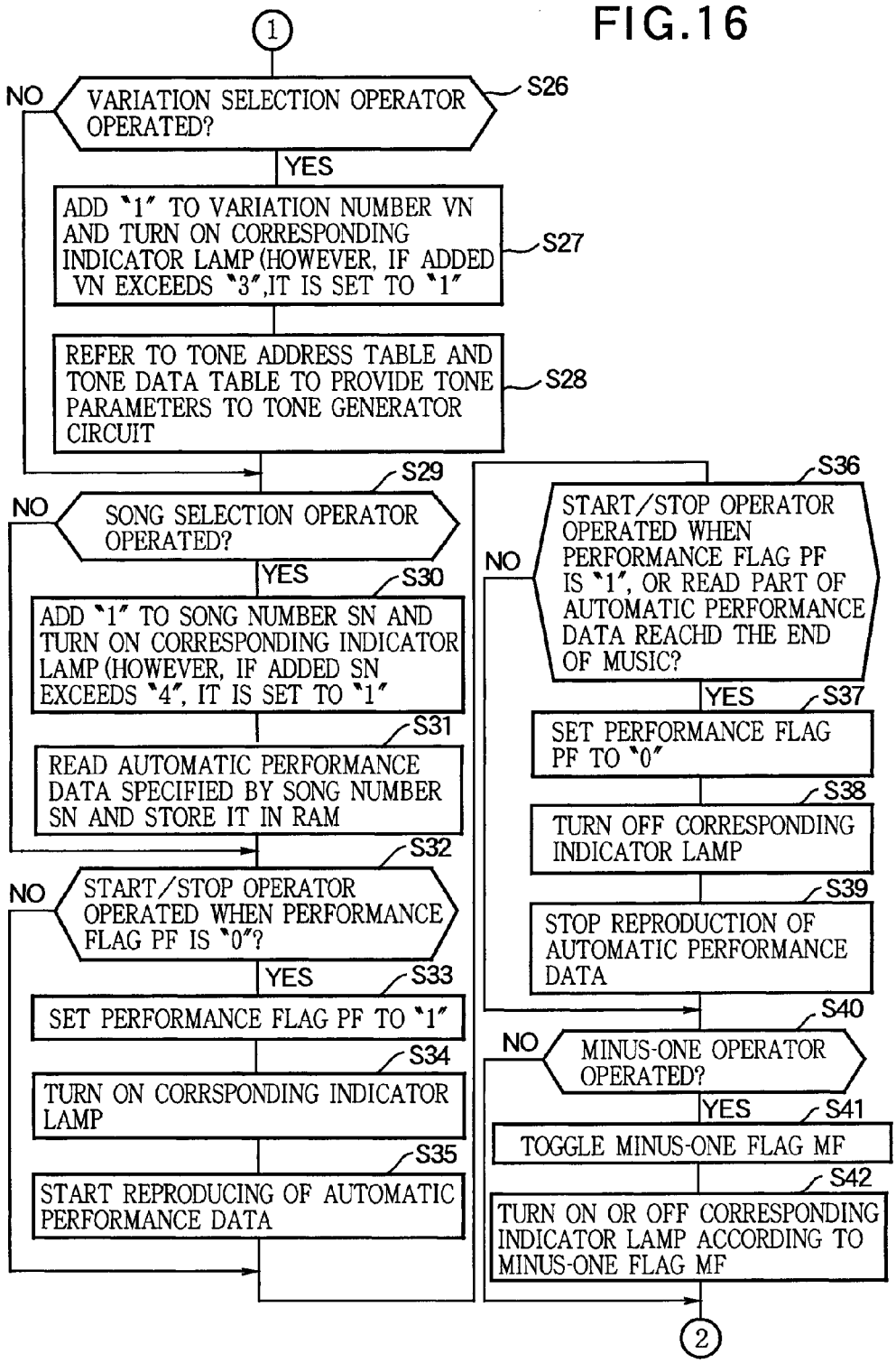
FIG.16
1
VARIATION SELECTION OPERATOR OPERATED?
S26
NO
YES
ADD "1" TO VARIATION NUMBER VN AND TURN ON CORRESPONDING INDICATOR LAMP (HOWEVER, IF ADDED VN EXCEEDS "3",IT IS SET TO "1"
S27
REFER TO TONE ADDRESS TABLE AND TONE DATA TABLE TO PROVIDE TONE PARAMETERS TO TONE GENERATOR CIRCUIT
S28
S29
SONG SELECTION OPERATOR OPERATED?
NO
YES
S30
ADD "1" TO SONG NUMBER SN AND TURN ON CORRESPONDING INDICATOR LAMP (HOWEVER, IF ADDED SN EXCEEDS "4", IT IS SET TO "1"
S31
READ AUTOMATIC PERFORMANCE DATA SPECIFIED BY SONG NUMBER SN AND STORE IT IN RAM
S32
START/STOP OPERATOR OPERATED WHEN PERFORMANCE FLAG PF IS "0"?
NO
YES
S33
SET PERFORMANCE FLAG PF TO "1"
S34
TURN ON CORRSPONDING INDICATOR LAMP
S35
START REPRODUCING OF AUTOMATIC PERFORMANCE DATA
S36
START/STOP OPERATOR OPERATED WHEN PERFORMANCE FLAG PF IS "1", OR READ PART OF AUTOMATIC PERFORMANCE DATA REACHD THE END OF MUSIC?
NO
YES
S37
SET PERFORMANCE FLAG PF TO "0"
S38
TURN OFF CORRESPONDING INDICATOR LAMP
S39
STOP REPRODUCTION OF AUTOMATIC PERFORMANCE DATA
S40
MINUS-ONE OPERATOR OPERATED?
NO
YES
S41
TOGGLE MINUS-ONE FLAG MF
S42
TURN ON OR OFF CORRESPONDING INDICATOR LAMP ACCORDING TO MINUS-ONE FLAG MF
2

FIG.21

SETTING INFORMATION

| | |
|---|---|
| ■MUSICAL INSTRUMENT SETTING | PIANO |
| ■VARIATION SETTING | VARIATION 1 |
| ■TONE NAME | ELECTRIC PIANO |
| ■SONG SETTING | SONG 2 |
| ■PERFORMANCE STATE | PERFORMANCE IN PROGRESS |
| ■MINUS-ONE STATE | OFF |
| ■SET TEMPO VALUE | 120 |
| ■SET VOLUME VALUE | 64 |

FIG.27

```
***LOG***
0001 : DETECTION DRIVER INITIALIZATION
0002 : DISPLAY DRIVER INITIALIZATION
...
(OMITTED)
...
0204 : PRINTER Configuration PROCESS
0205 : PRINTER GetCapability PROCESS
...
(OMITTED)
...
3728 : MIDI I/F RECEIVE "90 3C 70"
3729 : TONE GENERATION DRIVER PORT 1 WRITE "90 3C 70"
3730 : PERFORMANCE OPERATOR RECEIVE "90 4C 74"
3731 : TONE GENERATION DRIVER PORT 1 WRITE "90 4C 74"
...
(OMITTED)
...
4474 : SWITCH 1 TURNED ON
4475 : SWITCHED TO SONG MODE
4476 : SONG LIST DISPLAYED ON DISPLAY
...
(OMITTED)
...
***SETTING STATES***
```

| MODULE | DATA NAME | VALUE |
|---|---|---|
| TEMPO | TEMPO | 120 |
| SOUND MODULE | METRONOME | OFF |
| SOUND MODULE | MASTER TUNING | 00 |
| SOUND MODULE | TRANSPOSE | 00 |
| SOUND MODULE | DSP TYPE | 01 |
| SOUND MODULE | CONFIG. TABLE | 01 |
| SOUND MODULE | CUSTOM TABLE EDIT | ALL OFF |
| MIDI | I/O FILTER | ALL ON |
| KEYBOARD | VELOCITY FIX R | 110 |
| KEYBOARD | VELOCITY FIX L | 110 |
| KETBOARD | VELOCITY FIX ON/OFF L | OFF |
| KEYBOARD | VELOCITY FIX ON/OFF R | OFF |

...
(OMITTED)
...

ELECTRONIC MUSICAL INSTRUMENT WITH DIRECT PRINT INTERFACE

BACKGROUND OF THE INVENTION

1. Technical Field of the Invention

The present invention relates to an electronic musical instrument which is connectable to a printer so that it can perform printing.

Specifically, the present invention relates to an electronic musical instrument suitable for use in printing tone setting parameters, a performance guide image, and the like.

Further, the present invention relates to an electronic musical instrument whose operating modes are set by a plurality of operators mounted on an operating panel.

2. Description of the Related Art

A conventional electronic musical instrument has a display for displaying a variety of information. For example, information such as tone parameters is displayed on the display. Japanese Patent Application Publication No. 2004-117487 has disclosed a technology in which an electronic musical instrument and a printer are connected to a personal computer so that electronic music score data on the personal computer are printed through the printer, and that performance data generated from the electronic music score data is used to cause the electronic musical instrument to generate a corresponding musical sound.

However, in the technology of Japanese Patent Application Publication No. 2004-117487, information regarding the electronic musical instrument cannot be output through the printer without involving a personal computer. A display such as a LCD for electronic musical instruments mostly has a small screen with low resolution, compared to a display for personal computers. Thus, it is difficult to identify setting states of the electronic musical instrument at a glance and there is a demand for the capability to print a list of setting states so that the user can identify the setting states at a glance. Further, in the electronic musical instrument, the displayed content may vary as a song proceeds. For example in case when a guide such as key positions for the song is displayed, since the displayed information is continuously switched as the song proceeds, it is not possible to view information displayed over a specific time period. Therefore, there is a demand for the capability to print a list of such displayed information.

The conventional technology has not suggested that the electronic musical instrument is connected directly to the printer or that setting states of the operating modes of the electronic musical instrument that have been set using operators on the instrument, are printed. Recent electronic musical instruments have a high performance and require complex manipulations (or operations). Thus, when the electronic musical instrument performs an unintended operation, the user cannot immediately determine whether the unintended operation is caused by an erroneous operation by the user or caused by a failure of the electronic musical instrument. Especially, when the electronic musical instrument has no screen display function, it is difficult for the user to review setting states of its operating modes that have been set by using the operators.

PictBridge (registered trademark), which is a technology for Digital Still Cameras (DSC), is known as a scheme in which a DSC and a printer are connected directly through a USB cable without involving a computer so that the printer can print images in the DSC (for example, see "White Paper of CIPA DC-001-2003 Digital Photo Solutions for Imaging Devices (Japanese)" Feb. 3, 2003, Camera & Imaging Products Association).

Recent electronic musical instruments have a high performance and require complex manipulations (or operations). Thus, when the electronic musical instrument performs an unintended operation, it is very difficult for the user to determine whether the unintended operation is caused by an erroneous operation by the user or caused by a software or hardware failure of the electronic musical instrument.

In addition, since the electronic musical instrument has a small display despite the complexity of its functions, it is difficult to display all states of the electronic musical instrument and it may also be difficult for the user to determine the states of the electronic musical instrument.

Users have a desire to view a history of operations or current states of the electronic musical instrument for better understanding, and also users have a desire to view a history of operations when they make a query to the manufacturer or the like. In addition to print the information regarding the electronic musical instrument, it is necessary to connect each of the electronic musical instrument and the printer to a computer as in the above electronic musical system.

SUMMARY OF THE INVENTION

Therefore, the present invention has been made in view of the above circumstances, and it is an object of the present invention to provide an electronic musical instrument which can easily print information regarding the electronic musical instrument or information regarding music.

It is another object of the present invention to provide an electronic musical instrument which makes it possible to easily confirm setting states of its operating modes that have been set by using operators mounted on an operating panel.

It is a further object of the present invention to provide an electronic musical instrument which can be connected directly to a printer and thus can print information regarding the electronic musical instrument such as its operation history or states through the printer.

In order to solve the above problems, the present invention provides the following configurations. In a general concept, the inventive electronic musical instrument comprises: an input device that inputs performance information; a tone generator that operates based on setting parameters for generating music sounds according to the performance information; an image data generation part that generates image data which represents either of the performance information or the setting parameters; and an interface that is directly connectable to an external printer for outputting the image data to the external printer.

Specifically in a first aspect of the invention, an electronic musical instrument comprises: an input device that inputs performance information; a tone generator that operates based on tone setting parameters for generating music sounds according to the performance information; a display that is capable of switching a plurality of scenes for displaying either of the performance information or tone setting parameters; an image data generation part that creates one or a plurality of print image data representing contents of the plurality of the scenes upon detecting a print instruction operation; and an interface that outputs the print image data to an external printer for printing the contents of the scenes.

Preferably, the electronic musical further comprises a print capability acquisition part that acquires information indicating whether or not the external printer has a predetermined print capability through the interface, wherein the image data generation part creates appropriate print image data depending on the acquired information indicating whether or not the printer has the predetermined print capability.

Preferably, the display comprises a plurality of display elements having different shapes and different positions, each display element changing its display state in response to the switching of the scenes. The electronic musical instrument further comprises a display element information storage part that stores respective positions and shapes of the display elements. The image data generation part creates the print image data based on both of the positions and shapes of the display elements stored in the display element information storage part and the display states of the display elements which change in each scene.

Preferably, the display further comprises a display face on which a character or figure is printed. The electronic musical instrument further comprises a display face print information storage part that stores a position and shape of the character or figure. The image data generation part creates the print image data based on the position and shape of the character or figure stored in the display face print information storage part.

Preferably, the image data generation part creates a plurality of the print image data corresponding respectively to the plurality of the scenes so as to print out one scene in one page.

Preferably, the image data generation part creates one print image data for two or more of the scenes so that the printer prints out the two or more scenes in one page.

Preferably, the display sequentially displays the plurality of the scenes which are automatically switched as the generating of the music sounds progresses.

Preferably, the display sequentially displays the plurality of the scenes to indicate pitches of the music sounds based on the performance information including note-on events indicating generations of the music sounds and a duration indicating a time interval between the generations of the music sounds, and the display displays each scene based on one note-on event or a plurality of note-on events without duration therebetween in the performance information.

Preferably, the display displays the scenes according to display image data which represents the contents of the performance information or tone setting parameters, and the image data generation part creates, as the print image data, the same image data as the display image data.

The invention includes a machine readable medium for use in an electronic musical instrument having an input device that inputs performance information, a tone generator that operates based on tone setting parameters for generating music sounds according to the performance information, a display device, an interface directly connectable to an external printer, and a processor. The machine readable medium contains a program executable by the processor for causing the electronic musical instrument to perform: a display process of switching a plurality of scenes for displaying either of the performance information or tone setting parameters on a screen of the display device; a creation process of creating one or a plurality of print image data representing contents of the plurality of the scenes upon detecting a print instruction operation; and an output process of outputting the print image data to the external printer through the interface for printing the contents of the scenes.

According to the first aspect of the present invention, one or a plurality of print image data representing contents of a plurality of scenes is created upon detecting a specific print instruction operation, and the print image data is output to an external printer through an interface as described, whereby it is possible to easily print information regarding the electronic musical instrument or information regarding music.

In a second aspect of the invention, an electronic musical instrument comprises: a tone generator that generates music sounds; an operating panel that has a plurality of operators for setting an operating mode of the tone generator; a connection part that can be connected directly to a printer; an image data generation part that generates image data representing the setting state of the operating mode set by the plurality of the operators in a format suitable for the printer; and a print control part that transmits the generated image data to the printer through the connection part, thereby causing the printer to print an image of the setting state of the operating mode represented by the transmitted image data.

Preferably, the image data generation part previously stores panel image data representing an appearance of the operating panel, and generates the image data representing the setting state of the operating mode by integrating images of the plurality of the operators into an image of the appearance of the operating panel represented by the panel image data.

Preferably, the electronic musical instrument further comprises an indicator lamp indicating the setting state of the operating mode in correspondence to at least a part of the plurality of the operators on the operating panel, wherein the image data generation part generates the image data representing the setting state of the operating mode set by the plurality of the operators in association with an indication of the indicator lamp.

Preferably, the image data generation part generates the image data for displaying characters representing the setting state of the operating mode set by the plurality of the operators.

The invention includes a machine readable medium for use in an electronic musical instrument having a tone generator that generates music sounds, an operating panel that has a plurality of operators for setting an operating mode of the tone generator, a connection part that can be connected directly to a printer, and a processor. The inventive machine readable medium contains a program executable by the processor for causing the electronic musical instrument to perform: an image data generation process of generating image data representing the setting state of the operating mode set by the plurality of the operators in a format suitable for the printer; and a print control process of transmitting the generated image data to the printer through the connection part, thereby causing the printer to print an image of the setting state of the operating mode represented by the transmitted image data.

In the electronic musical instrument configured as described above, the printer can be connected to the electronic musical instrument through the connection part to print image data representing the setting state of the operating mode set by the operators. Thus, through this printout, the user can easily check the setting state of the operating mode which is set by using the operators, and can also easily query its relevant manufacturer about operations of the electronic musical instrument by sending the printed material to the manufacturer via facsimile. This is very effective for an electronic musical instrument that has no screen display function to display its setting states which are set by using the operators. In addition, the electronic musical instrument does not require complex operations since the printer can be used by connecting it directly to the electronic musical instrument and there is no need to use a personal computer or the like for the connection.

In a third aspect of the invention, an electronic musical instrument comprises: a main part including a tone generator and a manual operator for generating music tones from the tone generator by playing the manual operator under a current setting state; a connection part that connects the electronic musical instrument to an external printer; an acquisition part that acquires an image data format printable by the external printer; an image generation part that generates image data representing the current setting state of the main part in the acquired image data format; and a print instruction part that transmits the generated image data to the external printer through the connection part, thereby causing the external printer to print the current setting state of the main part.

Another electronic musical instrument comprises: an input part including one or more operators for inputting either of setting operation for setting the electronic musical instrument or performance operation; a tone generator part that generates music tones in response to the performance operation; a connection part that connects the electronic musical instrument to an external printer; an acquisition part that acquires an image data format printable by the external printer; a recording part that records a log which is at least one of a history of operations of the operators and a transition of the setting state of the electronic musical instrument based on a sequence of setting operations by the operators; an image generation part that generates image data representing the recorded log in the acquired image data format; and a print instruction part that transmits the generated image data to the external printer through the connection part, thereby causing the external printer to print the log according to the generated image data.

Preferably, the electronic musical instrument further comprises a reception part that receives performance information for use in the tone generator part to generate the music tones according to the received performance information and receives setting information for use in setting of the various parts of the electronic musical instrument from external equipment, wherein the recording part records a log which is a history of the reception of the performance information and setting information and a transition of the setting state of the electronic musical instrument due to the setting information.

The invention includes a machine readable medium for use in an electronic musical instrument having a main part including a tone generator and a manual operator for generating music tones from the tone generator by playing the manual operator under a current setting state, a connection part that connects the electronic musical instrument to an external printer, and a processor. The inventive machine readable medium contains a program executable by the processor for causing the electronic musical instrument to perform: an acquisition process of acquiring an image data format printable by the external printer; an image generation process of generating image data representing the current setting state of the main part in the acquired image data format; and a print instruction process of transmitting the generated image data to the external printer through the connection part, thereby causing the external printer to print the current setting state of the main part.

The invention includes another machine readable medium for use in an electronic musical instrument having an input part including one or more operators for inputting either of setting operation for setting the electronic musical instrument and performance operation, a tone generator part that generates music tones in response to the performance operation, a connection part that connects the electronic musical instrument to an external printer, and a processor. The inventive machine readable medium contains a program executable by the processor for causing the electronic musical instrument to perform: an acquisition process of acquiring an image data format printable by the external printer; a recording process of recording a log which is at least one of a history of operations of the operators and a transition of the setting state of the electronic musical instrument based on a sequence of setting operations by the operators; an image generation process of generating image data representing the recorded log in the acquired image data format; and a print instruction process of transmitting the generated image data to the external printer through the connection part, thereby causing the external printer to print the log according to the generated image data.

According to the third aspect of the present invention, it is possible to provide an electronic musical instrument which can be connected directly to a printer and thus can print information regarding the electronic musical instrument such as its operation history or current states through the printer.

BRIEF DESCRIPTION OF THE DRAWINGS

FIG. 16 is a flow chart illustrating a middle part of the program.

FIG. 21 is a diagram illustrating another example printout which lists setting states of the operating panel.

FIG. 27 is a conceptual diagram illustrating an example of image data created at a process shown in FIG. 26.

DETAILED DESCRIPTION OF THE INVENTION

A first aspect of the present invention will be described in detail with reference to FIG. 1 through FIG. 11.

1. Overview of Embodiments

First, an overview of the operation of the first and second embodiments is described.

Figure 1A:
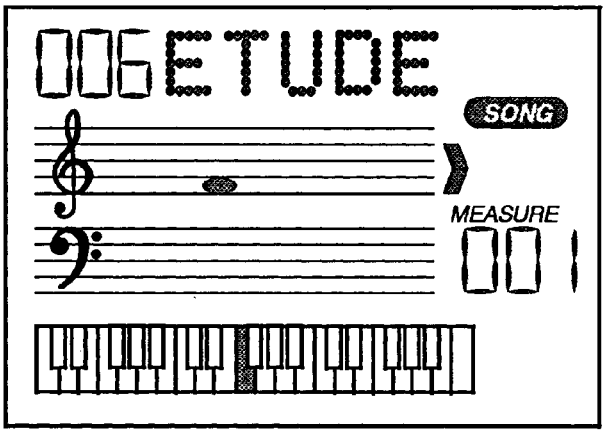
FIGS. 1*a* and 1*b* illustrate an example screen and an example print of a display provided in a first embodiment of the electronic musical instrument according to the first aspect of the present invention.
Figure 1B:
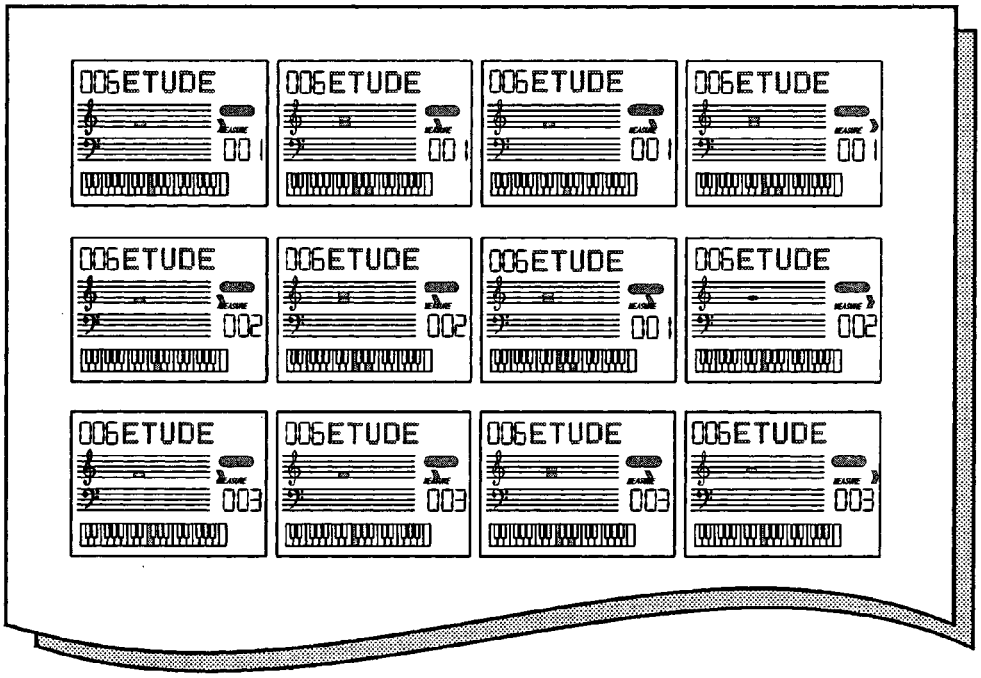

The first embodiment an application of the present invention to an electronic musical instrument such as an electronic piano for beginners. In the first embodiment, a segment-type liquid crystal display (LCD) is used to display a variety of information. The segment-type display is a display device in which electrodes are previously formed with the same shapes as those of characters or figures to be displayed. FIG. 1*a* shows an example screen of the display of the first embodiment. This screen shows a guide display scene on which the pitches and the positions of keys to be pressed are displayed as a music (or song) proceeds, and the displayed content sequentially varies as the music proceeds. In the first embodiment, if a specific print instruction is issued during playback of the music, the content of the screen that constantly varies throughout the music is printed on a sheet of paper such that a number of corresponding thumbnails are arranged on the paper as shown in FIG. 1*b*. By viewing the printout, even users who are not good at reading the music score can learn the positions of keys to be depressed throughout the music.

Figure 2A:
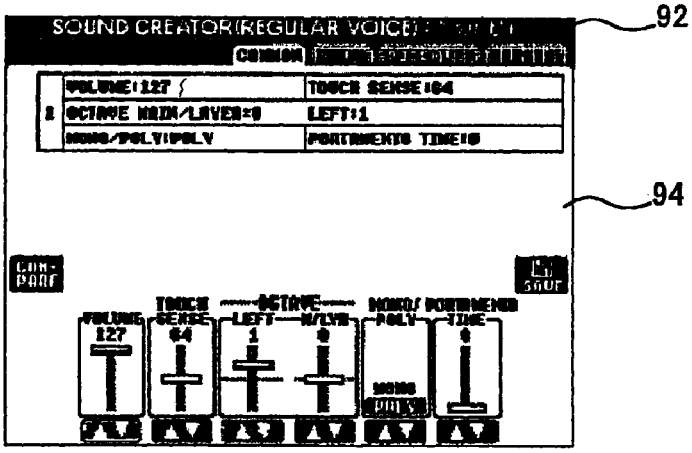
FIGS. 2*a* and 2*b* illustrate an example screen and an example print of a display provided in a second embodiment of the present invention.
Figure 2B:
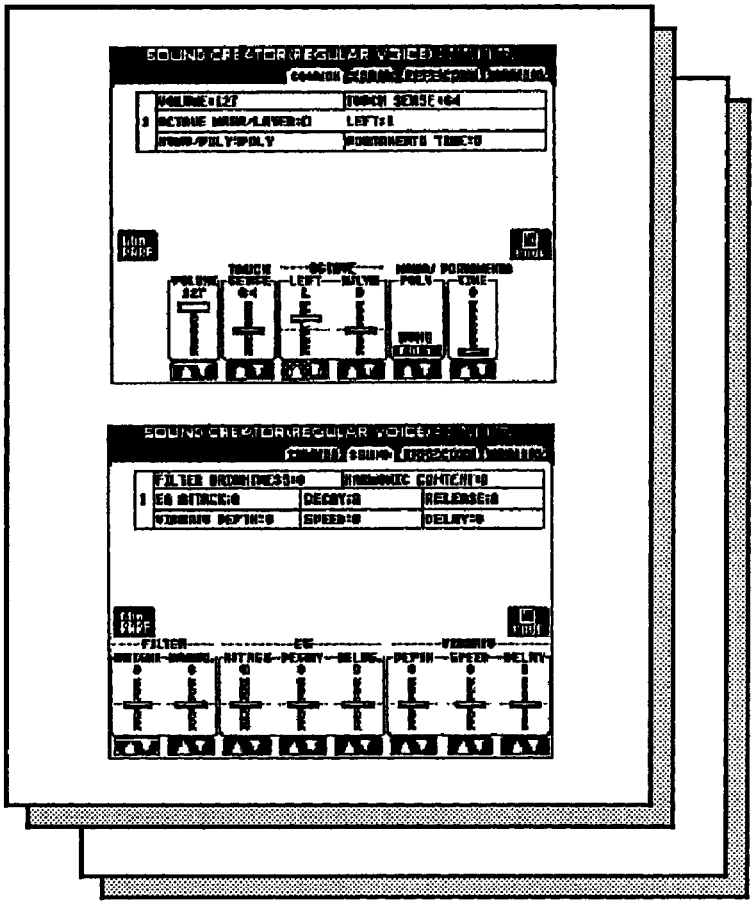

The second embodiment is an application of the present invention to a synthesizer that allows the user to specify a variety of tone parameters or the like. The second embodiment uses a dot-matrix display and flexibly changes content displayed on a screen based on the content of display image data. To specify a tone, it is generally necessary to set a number of parameters. However, since the display mounted on the electronic musical instrument is relatively small and also has low resolution, it is difficult to display all necessary information by one scene of the display. Therefore, as shown in FIG. 2*a*, a tag portion 92 on which 4 tags are arranged is provided in a tone setting screen, and the content of a field portion 94 is determined according to which tag is selected. In the second embodiment, if a specific print instruction is issued with a scene associated with one of the 4 tags selected, scenes associated with all the tags are printed on a sheet of paper as shown in FIG. 2*b*. Here, two scenes are printed on each page of paper. By viewing the printout, the user can identify setting states of all parameters for setting a tone.

2. First Embodiment

2.1. Hardware Structure

The configuration of an electronic musical instrument 100 according to an embodiment of the present invention will now be described with reference to FIG. 3.

Figure 3:
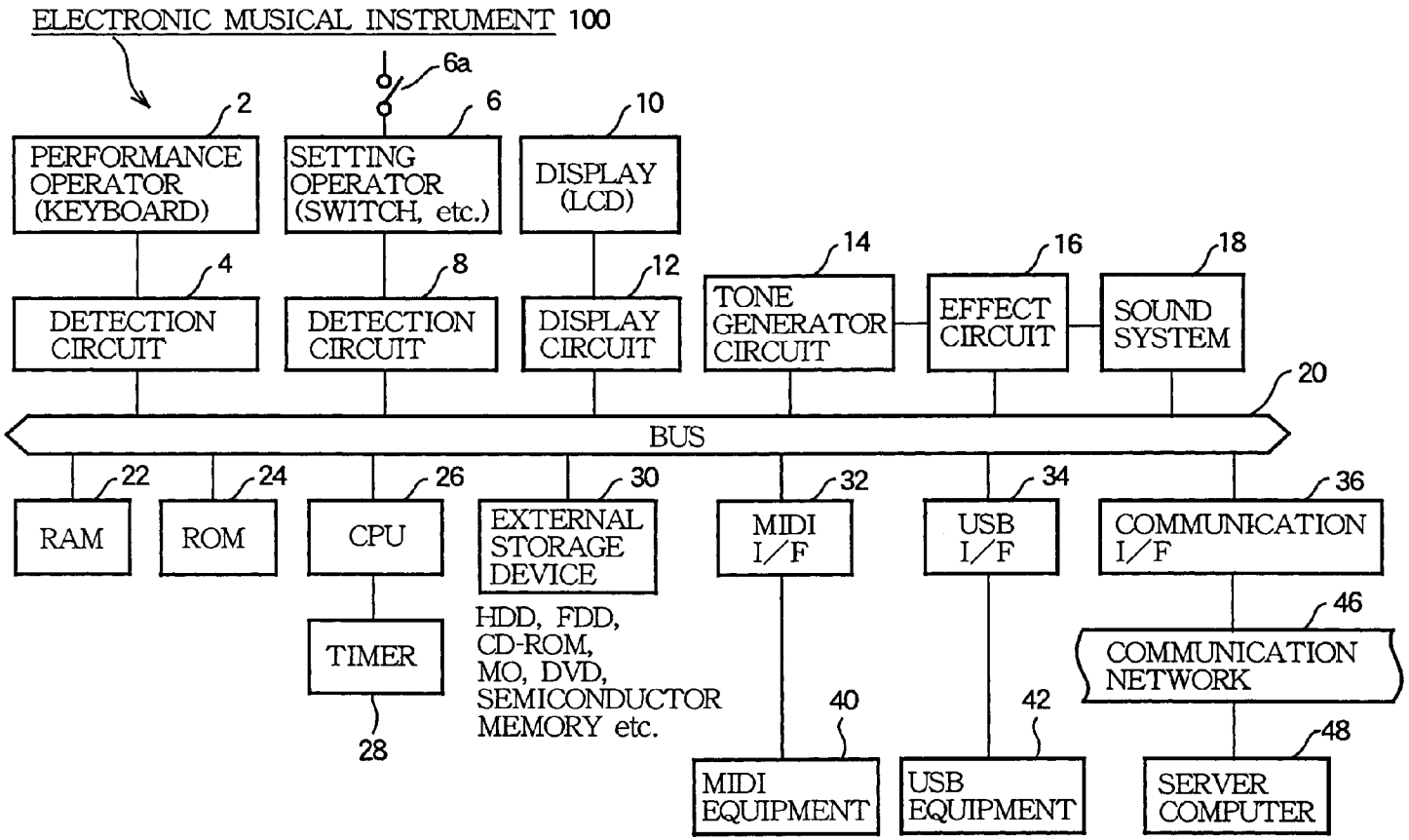
FIG. 3 is a block diagram of an electronic musical instrument of the first embodiment.

In FIG. 3, "2" denotes a performance operator including a keyboard or the like. "4" denotes a detection circuit which detects and outputs operating states of the performance operator 2 through a bus 20. "10" denotes a display including a segment-type LCD which is driven by a display circuit 12 to display a variety of information based on a display command provided from a CPU 26 to the display circuit 12. "6" denotes a setting operator which includes a variety of operators for setting a variety of operating states of the electronic musical instrument 100. Especially, the setting operator 6 of this embodiment includes a print instruction button 6*a* for issuing an instruction to print information regarding content displayed on the display 10. "8" denotes a detection circuit which detects operating states of the setting operator. "14" denotes a tone generator circuit which synthesizes a musical sound signal based on performance information provided from the CPU 26. "16" denotes an effect circuit which imparts special effects to the musical sound signal.

"18" denotes a sound system which generates a sound corresponding to a musical sound signal output from the effect circuit 16. "26" denotes a CPU which controls other components through the bus 20 based on a program stored in the ROM 24. "22" denotes a RAM which is used as a work memory of the CPU 26. "28" denotes a timer that measures the current time and generates and provides a timer interrupt to the CPU 26 as needed. "30" denotes an external storage device which includes a storage medium such as a hard disk, a flexible disk, a CD-ROM, a MO, a DVD, or a semiconductor memory and a drive device for the storage medium. 32"denotes a MIDI interface which receives and outputs a MIDI signal from and to external MIDI equipment 40. "34" denotes a USB interface which receives and outputs a serial signal from and to external USB equipment 42. "36" denotes a communication interface which is connected to a server computer 48 or the like through an external communication network 46.

Figure 5A:
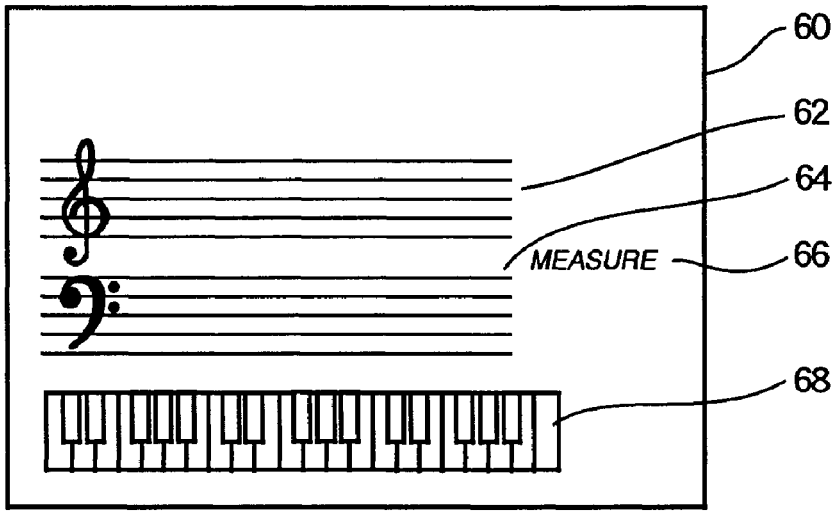
FIGS. 5*a* and 5*b* illustrate a detailed configuration of a display of the first embodiment.
Figure 5B:
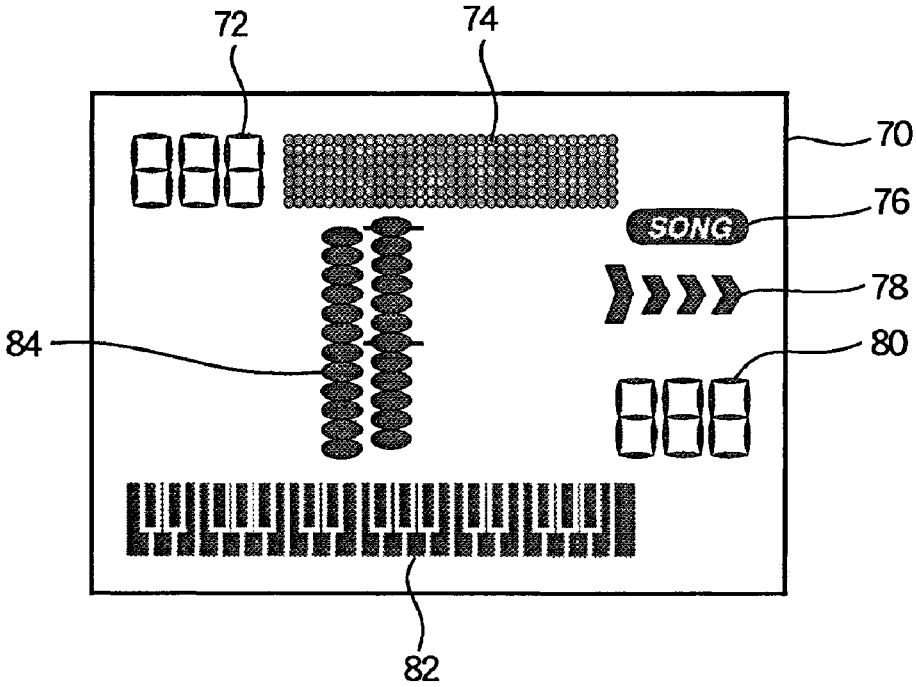

A detailed configuration of the display 10 will now be described with reference to FIG. 5. FIG. 5*a* shows a front face plate 60 that covers the top surface of the display 10. Characters and images of staffs 62 and 64 and a bar number title 66, and a keyboard FIG. 68 are printed with ink on the front face plate 60. An LCD is disposed in a layer under the front face plate 60. As shown in FIG. 5*b*, the LCD includes an electrode plate 70 on which various shapes of electrodes are disposed, a common electrode plate which faces the electrode plate 70, and a liquid crystal inserted between the two plates. The electrodes of the electrode plates 70 include a song number portion 72 for displaying a song number with 3 digits, a dot matrix portion 74 for displaying a variety of characters and the like, a playback state display portion 76 for displaying whether or not a song (or music) is being played back, a beat display portion 78 for displaying the beat in a bar, a bar number portion 80 for displaying a bar number in the song with 3 digits, a keyboard portion 82 for displaying a key to be depressed on the keyboard, and a pitch display portion 84 for displaying the pitch together with the staffs 62 and 64. The display 10 is of a normally white type so that, when a voltage is applied to an electrode to be turned on (for switching to "black"), a liquid crystal portion corresponding to the electrode is viewed in black. Accordingly, if the display 10 is viewed from the top with some electrodes turned on, the above-mentioned content as shown in FIG. 1*a* is displayed.

Content printed on the front face plate 60, the position and shape of each electrode on the electrode plate 70, and font information in addition to programs for the CPU 26 are stored in the ROM 24. The shape of each electrode and the content printed on the front face plate 60 are stored in a bitmap format on a rectangular palette. The position of each electrode is stored as its coordinate position on the palette corresponding to the front face plate 60. The font information includes dot patterns of characters used when displaying alphabetical letters on the dot-matrix portion 74.

2.2. USB Connection Protocols

Protocols for the USB interface 34 and the USB equipment 42 will now be described. Equipment that performs data communication through a USB cable is referred to as "USB equipment". Thus, both the electronic musical instrument 100 and the USB equipment 42 are "USB equipment". The USB equipment is divided into a "USB host" and a "USB device", which perform communication in such a manner that the USB device returns a response to the USB host in response to a command transmitted from the USB host. Since the electronic musical instrument 100 operates as a USB device, the USB equipment 42 connected to the USB interface 34 must be a USB host.

An overview of the USB interface 34 will now be described with reference to FIG. 4*c*. As shown in FIG. 4*c*, the USB interface 34 has respective end points for a mass storage, an audio device, and a still image capture device (SICD). The term "end point" refers to a virtual port used when the USB host transmits data or a command to the USB device. The inclusion of these end points in the electronic musical instrument 100 indicates that the electronic musical instrument 100 has corresponding functions.

Figure 4A:
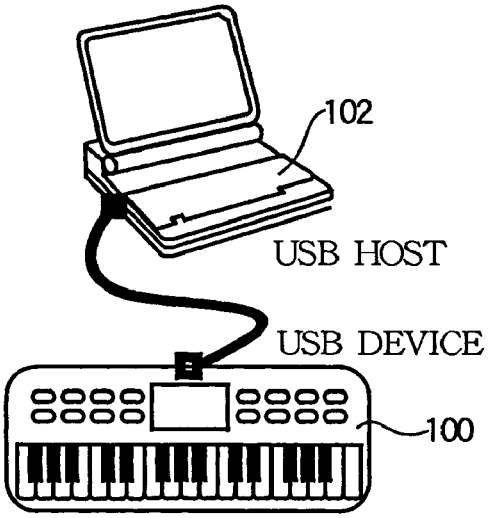
FIGS. 4*a*, 4*b* and 4*c* illustrate an overview of a USB interface.

FIG. 4*a* shows the electronic musical instrument 100 when the instrument 100 as a USB device is connected to a personal computer 102 as a USB host. The electronic musical instrument 100 functions as an audio device or mass storage when it is connected to the personal computer 102. When it functions as an audio device, the electronic musical instrument 100 receives and outputs a MIDI signal, a digital audio signal, and the like from and to the personal computer 102. In addition, the personal computer 102 can handle content on the electronic musical instrument 100 as a file when the electronic musical instrument 100 functions as a mass storage.

Figure 4B:
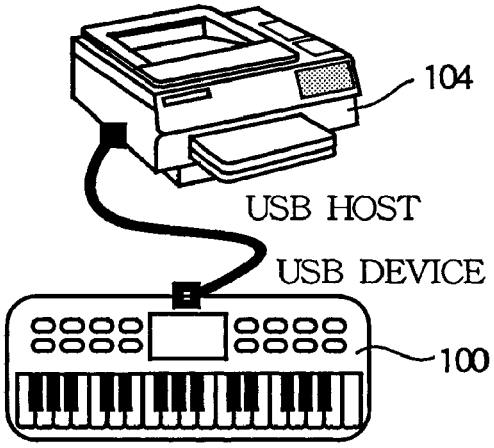
Figure 4C:
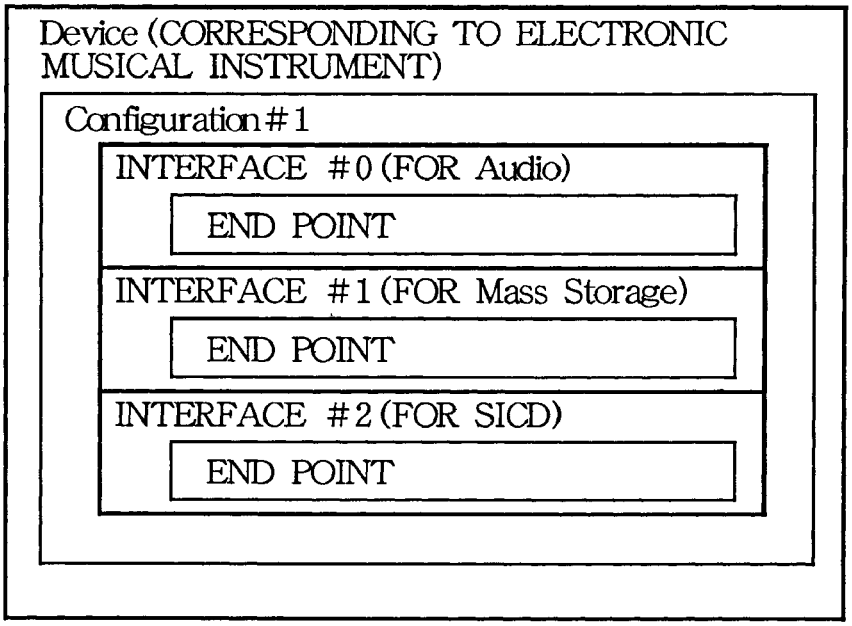

The electronic musical instrument 100 functions as a still image capture device (SICD) when it is connected to a printer 104 compatible with the PictBridge (registered trademark) standard as shown in FIG. 4*b*. That is, the electronic musical instrument 100 transmits image data to be printed to the printer 104 in response to a command from the printer 104 and the printer 104 then prints the image data.

2.3. Operation of First Embodiment 2.3.1. Overall Operation

The operation of the first embodiment will now be described. The USB interface 34 of the electronic musical instrument 100 and the printer 104 are connected through a USB cable. If both the electronic musical instrument 100 and the printer 104 are powered on, each detects the equipment type of each other (as a USB device or USB host). Each of the electronic musical instrument 100 and the printer 104 also detects that each other is PictBridge-enabled equipment. Then, the electronic musical instrument 100 detects that the printer 104 has a "print server function" of the PictBridge standard. In the following description, the electronic musical instrument 100 performs an operation for transmitting a variety of data to the printer 104 as needed based on an event generated at the electronic musical instrument 100. However, strictly speaking, communication between the electronic musical instrument 100 and the printer 104 is initiated at the printer as a USB host. Accordingly, the printer 104 polls the electronic musical instrument at specific time intervals and the printer 104 then detects an event that is generated at the electronic musical instrument 100 in response to the polling. In the following description, an operation for initiating communication based on an event from the electronic musical instrument 100 is an operation caused by the polling.

If a song (or music) to be printed is selected at the electronic musical instrument 100, then song information regarding the song is read from the external storage device 30 and is then loaded into the RAM 22. This song information is information in standard MIDI format (SMF) and includes MIDI data of a plurality of parts (such as right-hand and left-hand parts) which constitute the content of the music, text data which describes information such as a song name. On the display 10, the song number of the selected song is displayed in the song number portion 72 and the song name is displayed in the dot-matrix portion 74. The pitch, beat, bar number, and key position of a part (for example, the right-hand part) specified by the user is displayed as a guide on the display 10.

Figure 6:
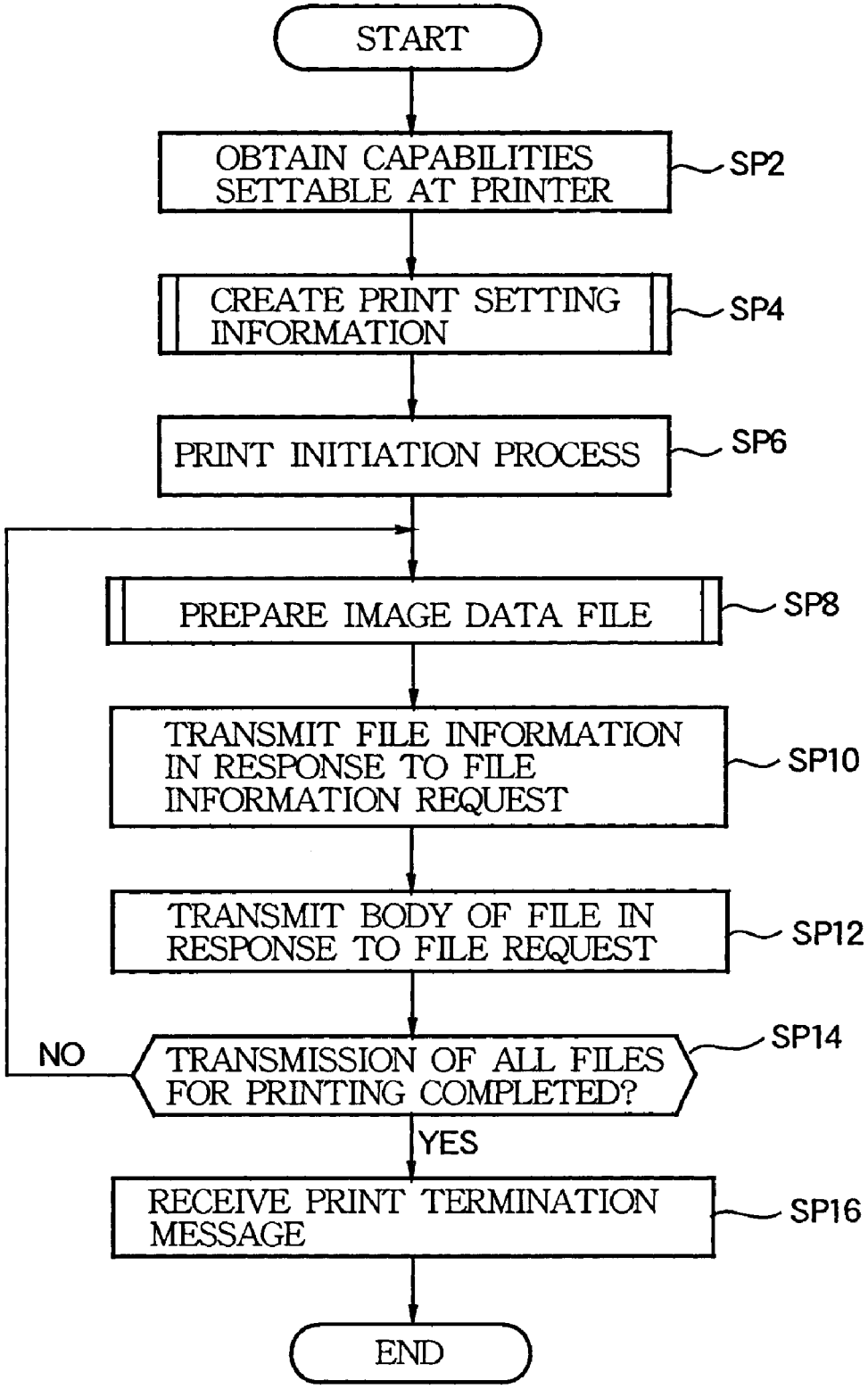
FIG. 6 is a flow chart of a print process main routine in the first embodiment.

Here, depressing a print instruction button 6*a* on the setting operator 6 activates a main routine of a print process shown in FIG. 6. Various terms used in this embodiment are defined as follows before explaining the operation of FIG. 6.

(1) Print Capability information: This is information provided from the printer 104 to the electronic musical instrument 100 and represents functions that can be implemented at the printer 104. This print capability information includes file formats supported by the printer 104, information indicating whether or not it supports a camera, and information indicating whether or not it has an index print function.

(2) File Name List Information: This is text data that lists file names of image data files provided from the electronic musical instrument 100 to the printer 104.

(3) File Information: This is information transmitted from the electronic musical instrument 100 to the printer 104 for each image data file before the image data file is transmitted to the printer 104. This file information includes the file name, file format (BMP, GIF, etc.), print format (color or monochrome), resolution, and file size of the image data file.

(4) Print Condition: Two methods can be considered when thumbnail images are printed through the printer 104. In the first method, an image data file is created for each thumbnail image and is then transmitted to the printer 104. In the second method, an image data file is created for each of a plurality of sets of thumbnail images and is then transmitted to the printer 104. Here, for example, the number of thumbnail images of each set is the number of thumbnail images that can be printed in parallel in the horizontal direction of a sheet of paper and is "4" in the example of FIG. 1*b*. The first method will be referred to as a print condition A and the second condition will be referred to as a print condition B.

(5) Basic File Information: In the PictBridge standard, a different file format, print format, and resolution can be set for each file through the file information. However, in this embodiment, the file format, print format, and resolution are set initially and are commonly applied to all image data files. Thus, the file format, print format, and resolution are referred to as basic file information.

(6) Print Setting Information: This is a combination of the print name list information, the print condition, and the basic file information.

Meanwhile, when the procedure of FIG. 6 proceeds to step SP2, a "DPS-GetCapability operation" in the PictBridge standard is performed. That is, the electronic musical instrument 100 transmits a specific request event to the printer 104 and then receives print capability information representing print capabilities of the printer 104 from the printer 104. Then, the procedure proceeds to step SP4 to call a print setting information creation subroutine, which is described later (see FIG. 7), thereby creating print setting information which is a combination of file name list information, a print condition, and basic file information. Then, the procedure proceeds to step SP6 to perform a print initiation process (i.e., a "DPS_StartJob operation" in the PictBridge standard). Here, the electronic musical instrument 100 transmits a print initiation request, together with the file name list information, to the printer 104.

Then, the procedure proceeds to step SPB to call an image data file preparation subroutine, which is described later (see FIG. 8), thereby creating an image data file to be transmitted to the printer 104 in a specific buffer area in the RAM 22. Since preparing all the image data files to be transmitted to the printer 104 at a time requires a significant capacity of buffer area, image data files are created one by one and each image data file is transmitted to the printer 104 each time it is created in this embodiment.

Upon receiving the file name list information and the print initiation request, the printer 104 requests a file information request to the electronic musical instrument 100. This corresponds to a DSP_GetFileInfo operation in the PictBridge standard and is to query the type, file size, and the like of an image data file that will be thereafter transmitted from the electronic musical instrument 100. On the other hand, when an image data file is created in the buffer area, the procedure proceeds to step SP10 at which the electronic musical instrument 100 transmits file information regarding the image data file created in the RAM 22 to the printer 104 in response to the file information request from the printer 104. More specifically, the procedure waits until the file information request is received if the request has not yet been received from the printer 104 at step SP10. If the file information request has already been received from the printer 104, the electronic musical instrument 100 transmits the file information as a response to the request.

If the printer 104 receives the file information and is then ready for receiving the body of the image data file, the printer 104 transmits a file request to the electronic musical instrument 100. This corresponds to a "DPS_GetFile operation" or a "DPS_GetThumb operation" of the PictBridge standard and is to request the electronic musical instrument 100 to transmit the body of the image data file. On the other hand, when the electronic musical instrument 100 completes the reception of the file information at step SP10, the procedure proceeds to step SP12 to transmit the body of the image data file to the printer 104 in response to the file request from the printer 104. Specifically, if the file request has not yet been received from the printer 104, the procedure waits until the file request is received and, if the file request has been received from the printer 104, the electronic musical instrument 100 transmits the body of the image data file as a response to the file request.

Then, the procedure proceeds to step SP14 to determine whether or not all image data files to be printed have been transmitted to the printer 104. If any file has not yet been transmitted, the determination of step SP14 is NO and the procedure from steps SP8 to SP14 is repeated until all the files have been completely transmitted. If all the files have been completely transmitted, the procedure proceeds to step SP16 at which the procedure waits until a "print termination message" is received from the printer 104. If the print termination message is received, then the procedure of the main routine is terminated.

On the other hand, a page buffer for storing image data to be printed on one page of paper is provided in the printer 104. If the electronic musical instrument 100 transmits an image data file through the procedure of steps SP8 to SP14, then image data based on the image data file is stored in the page buffer. If the page buffer becomes full, content in the page buffer is output to a sheet of paper. With reference to the previously received file name list information, the printer 104 continues transmitting the above-mentioned file information request to the electronic musical instrument 100 until it receives all image data files listed in the file name list information. If the printer 104 receives all image data files after transmitting the corresponding file information requests to the electronic musical instrument 100, then the printer 104 transmits the above-mentioned print termination message to the electronic musical instrument 100 and also outputs image data remaining in the page buffer to a sheet of paper. This operation corresponds to a "DPS_NotifyDeviceStatus operation" of the PictBridge standard.

2.3.2. Creation of Print Setting Information

The operation of a print setting information creation subroutine that is called at the above step SP4 will now be described with reference to FIG. 7.

Figure 7:
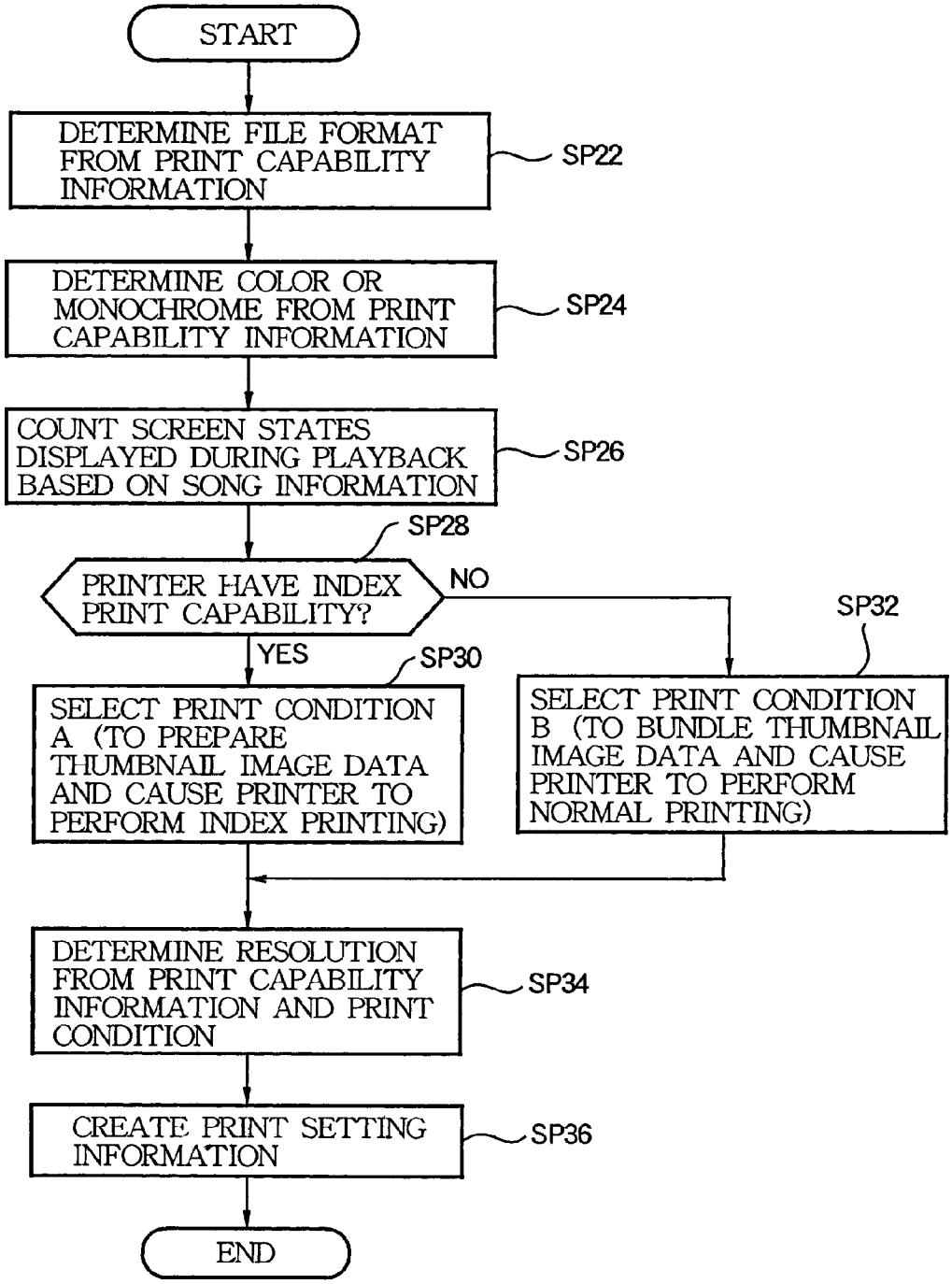
FIG. 7 is a flow chart of a print setting information creation subroutine in the first embodiment.

When the procedure of FIG. 7 proceeds to step SP22, a file format to be transmitted to the printer 104 is determined based on the print capability information previously obtained at step SP2. For example, if BMP (bitmap) and TIFF formats can be selected as the format of an image data file that can be transmitted by the electronic musical instrument 100 and the formats of files that can be received by the printer 104 are BMP and GIF formats, the common BMP format is selected as the format of the image data file.

Then, the procedure proceeds to step SP24 to select either "color" or "monochrome" as the print format of the image data file. Specifically, "color" is selected as the print format if the electronic musical instrument 100 has the capability to create color image data and the printer 104 also has a color print capability and "monochrome" is selected as the print format if one of the electronic musical instrument 100 and the printer 104 does not support "color".

The procedure then proceeds to step SP26 to count the number of screen states (namely, number of scenes) displayed on the display 10 when the song is played back, based on the current song information. Here, the screen states are described with reference back to FIG. 5*b*. On the electrode plate 70, the content of the bar number portion 80 is updated each time the bar is changed and the state of the beat display portion 78 is updated each time the beat proceeds. In addition, the display states of the pitch display portion 84 and the keyboard portion 82 are updated each time a note-on event is generated in a guide display target part. However, when a plurality of note-on events is generated without duration therebetween, these are note-on events of a chord so that they are simultaneously displayed in the pitch display portion 84 and the keyboard portion 82. When the display state of any of the beat display portion 78, the bar number portion 80, the keyboard portion 82, and the pitch display portion 84 is changed, it is counted as "screen state".

Returning to FIG. 7, when the procedure proceeds to step SP28, it is determined whether or not the print condition A can be selected, based on the print capability information of the printer 104. Specifically, it is determined whether the printer 104 has an index print function which is a function to arrange and print a number of miniature images. If the determination is YES, the procedure proceeds to step SP30 to select the print condition A. If the determination is NO, the procedure proceeds to step SP32 to select the print condition B. The procedure then proceeds to step SP34 to determine resolution of the image data file to be transmitted based on the print condition and the print capability information of the printer 104.

Then, the procedure proceeds to step SP36 to create print setting information. First, file name list information is created based on the print condition and the number of screen states (namely, number of scenes) counted at the above step SP26. For example, if the number of screen states is "200" and the print condition is "A", 200 file names such as "img_A_0001.bmp"~"img_A_0200.bmp" are determined. On the other hand, if the print condition is "B", the number of file names is determined based on (number of screen states)/(number of screen states in one image) which is rounded up. In the above example, 50 file names such as "img_B_0001.bmp"~"img_B_0200.bmp" are determined since the number of screen states in one image is "4". In any case, file name list information is created by listing the determined file names. In addition, basic file information is created based on the file format, print format, and resolution determined at steps SP22, SP24, and SP34. If print setting information is created by listing the file name list information, the print condition, and the basic file information, then the procedure of the main routine is terminated.

2.3.3. Preparation of Image File

Figure 8:
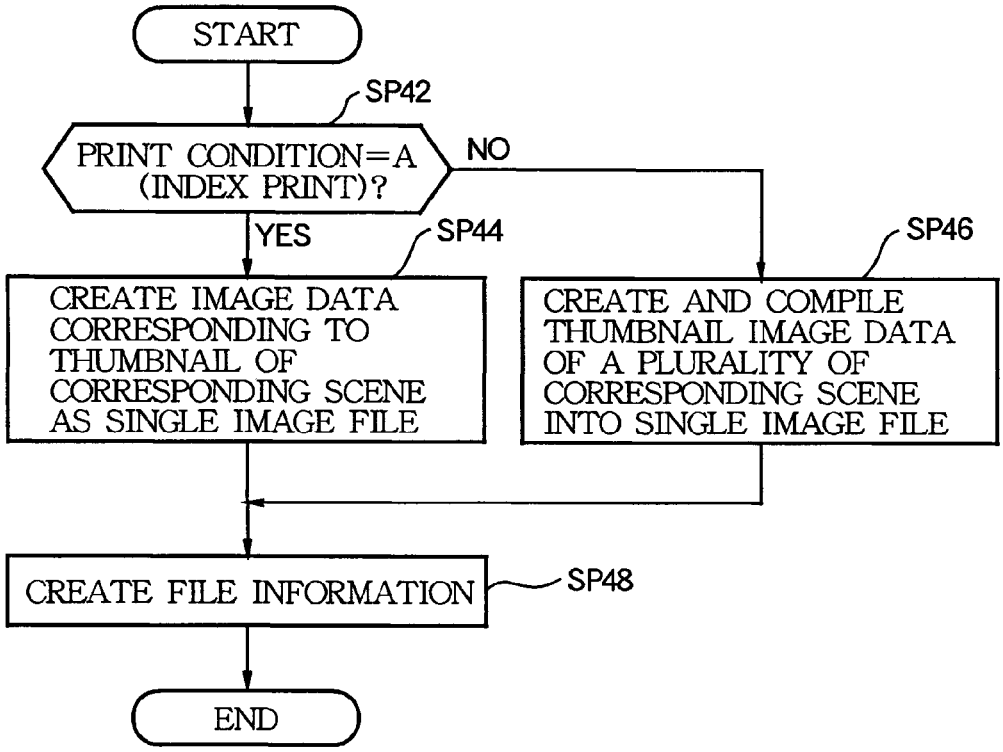
FIG. 8 is a flow chart of an image data file preparation subroutine in the first embodiment.

A procedure of the image data file preparation subroutine that is called at step SP8 will now be described with reference to FIG. 8. When the procedure of FIG. 8 proceeds to step SP42, it is determined whether or not the print condition A has been selected at the previous steps SP28 to SP32. If this determination is "YES", the procedure proceeds to step SP44. At step SP44, the content of a next screen state, namely next scene, is converted to image data and the image data is stored in a buffer area in the RAM 22 as an image data file associated with a file name that is previously specified by a file request from the printer 104.

On the other hand, if the determination of step SP42 is "NO", the procedure proceeds to step SP46. At step SP46, the content of a plurality of screen states (4 scenes in the example of FIG. 1*b*) that constitutes a next image data file is converted to image data and the image data is stored in a buffer area in the RAM 22 as an image data file associated with a file name that is previously specified by a file request from the printer 104.

Then, the procedure proceeds to step SP48 to create file information of the image data file. As described above, the file information includes the file name, file format (BMP, GIF, etc.), print format (color or monochrome), resolution, file size, and the like of the image data file. Of these elements, the file name is the same as that included in the file information request received from the printer 104. The file format, the printer format, and the resolution are the same as those specified in the basic file information. The file size is the same as that of the image data file created at the above step SP44 or SF46. Through these steps, the procedure of the main routine is terminated.

Figure 9:
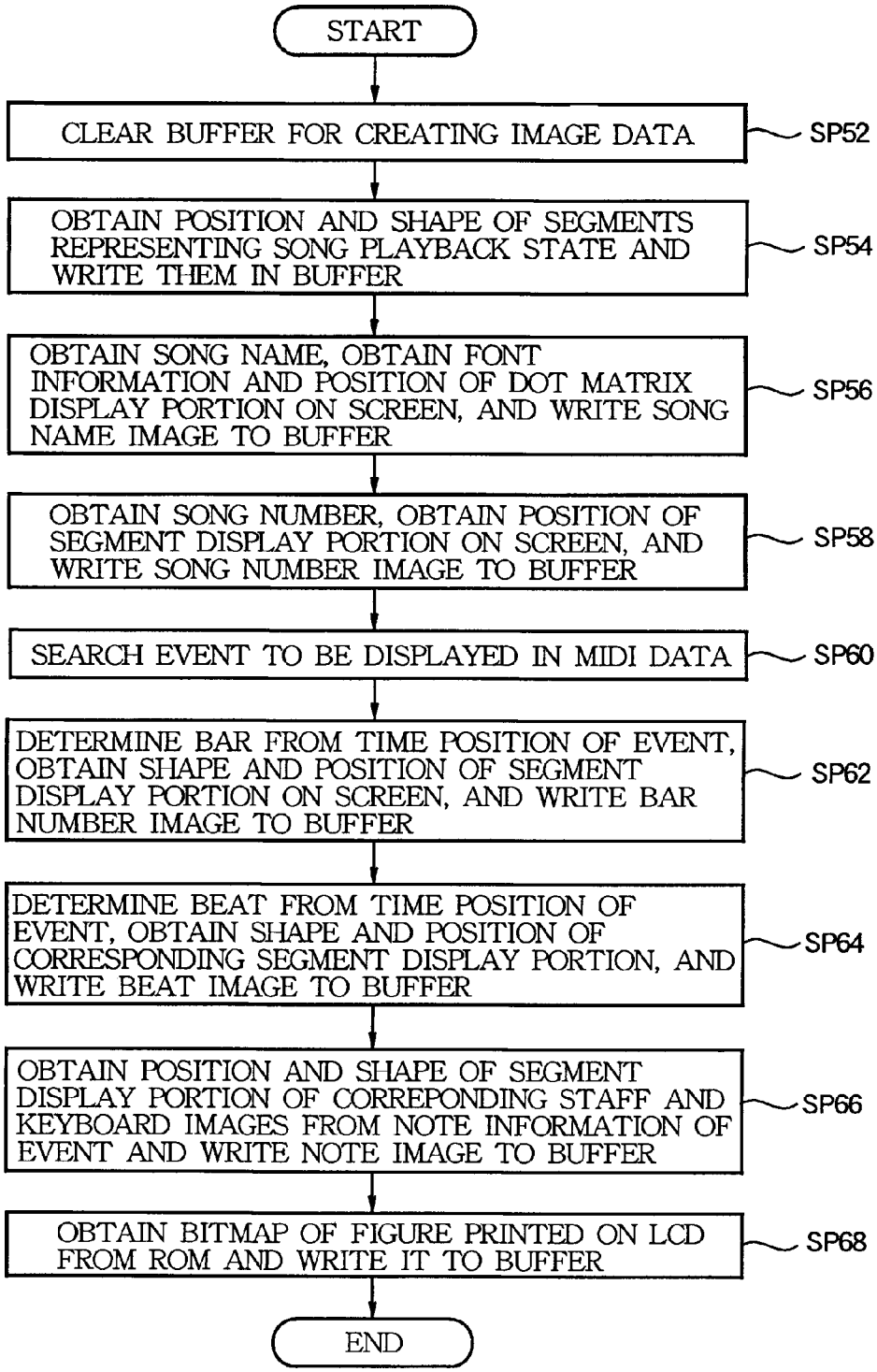
FIG. 9 is a flow chart of an image data file creation routine in the first embodiment.

Details of the procedure for creating the image data file at the above step SP44 will now be described with reference to FIG. 9. First, the procedure of FIG. 9 proceeds to step SP52 to clear the buffer area secured for creating the image data file in the RAM 22. The procedure then proceeds to step SP54. At step SP54, the position and shape (bitmap) data of the playback state display portion 76 on the display 10 which represents the playback state of a song is read from the ROM 24 and raster data of the playback state display portion 76 is written to a corresponding position in the buffer area. The procedure then proceeds to step SP56 to read a song name of a print target song from a specific area of the RAM 22. In addition, font information and the position of the dot matrix portion 74 on the display 10 are read from the ROM 24 and the song name is converted to a dot pattern based on the read font information and raster data created through this conversion is written to a corresponding position in the buffer area.

The procedure then proceeds to step SP58 to read the song number of the print target song from the specific area of the RAM 22. In addition, the position and shape of each of the electrodes that define the song number portion 72 is read from the ROM 24 and raster data that simulates a display state of the song number displayed on the song number portion 72 based on the read information is written to a corresponding position in the buffer area. The procedure then proceeds to step SP60 to search for one or a plurality of note-on events to be displayed in MIDI data associated with a guide display target part. If a plurality of note-on events is found, these will be note-on events without duration therebetween. This is because the plurality of note-on events is regarded as forming a chord as described above. The procedure then proceeds to step SP62 to obtain a bar number from the position of the found events. In addition, the position and shape of each of the electrodes that define the bar number portion 80 is read from the ROM 24 and raster data that simulates a display state of the bar number displayed on the bar number portion 80 based on the read information is written to a corresponding position in the buffer area.

The procedure then proceeds to step SP64 to specify an electrode to be turned on the pitch display portion 84 and the keyboard portion 82. If a plurality of note-on events which form a chord is found at the previous step SP60, a plurality of electrodes may be turned on simultaneously on each of the pitch display portion 84 and the keyboard portion 82. In addition, the position and shape of each of these electrodes is read from the ROM 24 and raster data that simulates the on state of an electrode corresponding to the current "beat" based on the read information is written to a corresponding position in the buffer area.

Then, when the procedure proceeds to step SP68, a bitmap that simulates the content (i.e., the staffs 62 and 64 and the bar number title 66, and the keyboard FIG. 68) printed on the front face plate 60 is read from the ROM 24 and is then written to a corresponding position in the buffer area. Through the above procedure, image data that simulates the same content of the "beat" as that displayed on the display 10 is created in the buffer area. Although the procedure performed at step SP44 corresponding to the print condition A is described above, the same procedure is performed at step SP46 corresponding to the print condition B. However, in the procedure of step SP46, the processes of the above steps SP54 to SP68 are repeated the same number of times as the number of screen states (4 screen states in the above example) to be included in one image data file.

3. Second Embodiment 3.1. Overall Configuration and Operation

Figure 10:
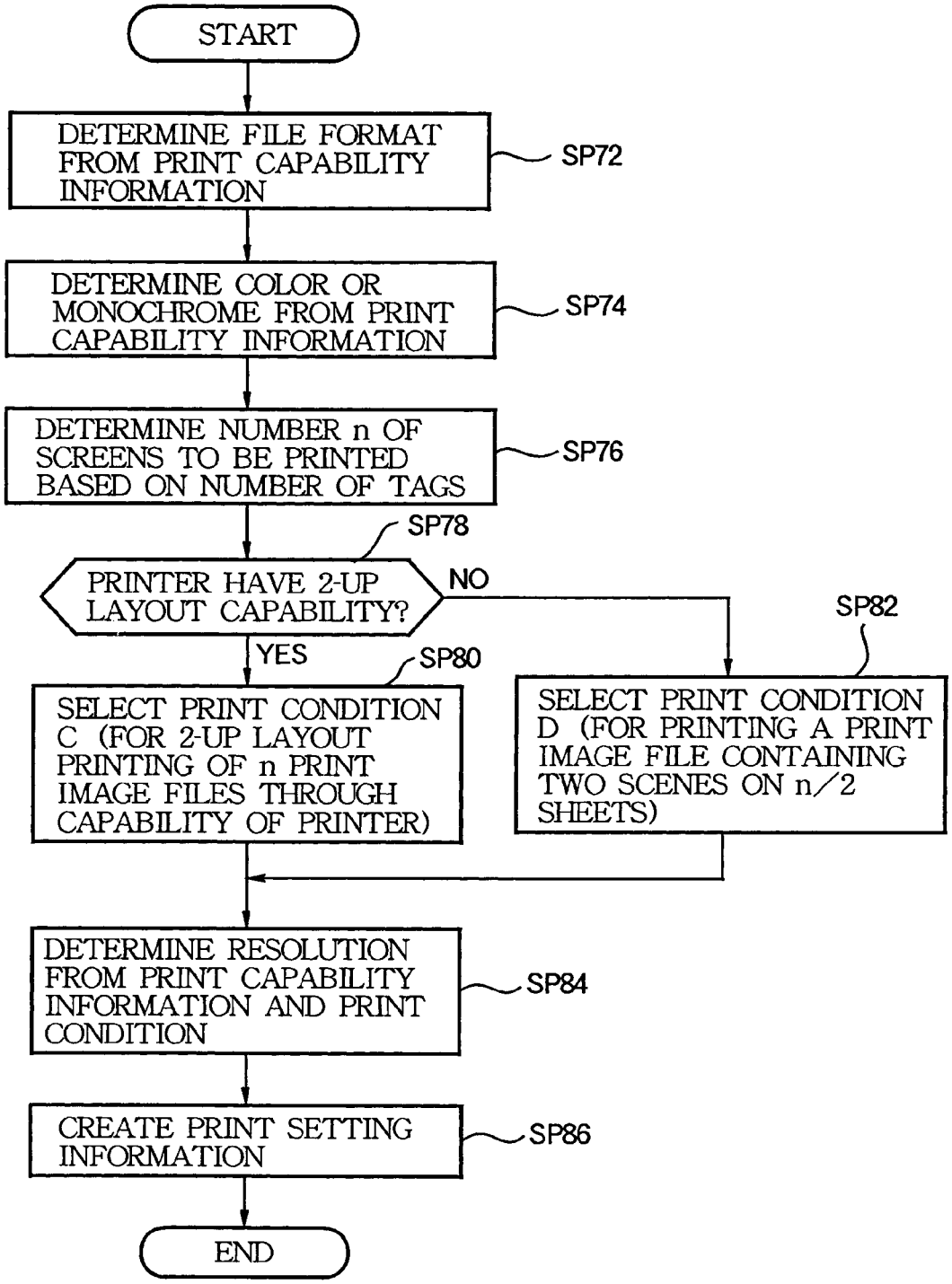
FIG. 10 is a flow chart of a print setting information creation subroutine in the second embodiment.
Figure 11:
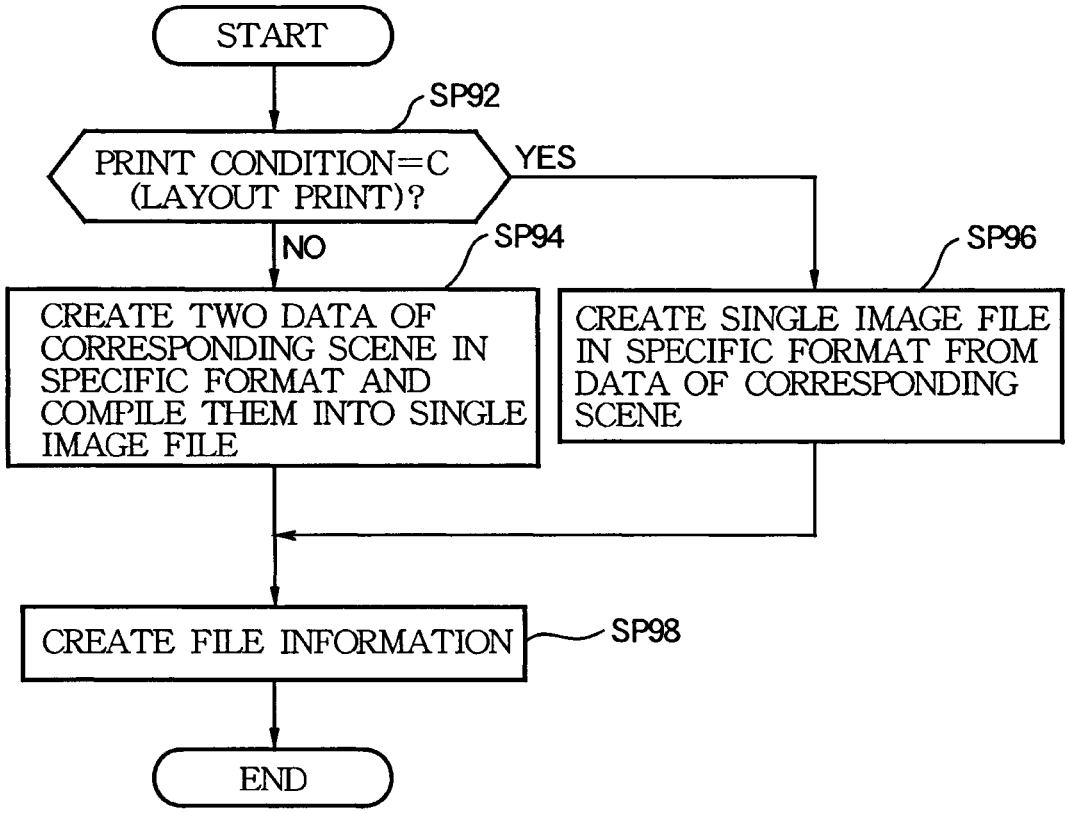
FIG. 11 is a flow chart of an image data file preparation subroutine in the second embodiment.

The second embodiment will now be described. Although the second embodiment has a hardware structure similar to that of the first embodiment, a display including a dot matrix formed over its entirety is used instead of the display 10 of the first embodiment. In addition, although processes of the main routine of a print process of the second embodiment are also similar to those of the first embodiment (see FIG. 6), the main routine of the second embodiment is different from that of the first embodiment in that a print setting information creation subroutine shown in FIG. 10 is called at step SP4 and an image data file preparation subroutine shown in FIG. 11 is called at step SP8. Processes of these routines will now be described in detail.

3.2. Creation of Print Setting Information

At steps SP72 and SP74 of FIG. 10, a file format transmitted to the printer 104 and a print format are determined based on print capability information in the same manner as steps SP22 and SP24 of FIG. 7. Then, the procedure proceeds to step SP76 at which the number of tags in a tag portion 92 currently displayed on the display is set as to a screen count "n" (i.e., the number of scenes). For example, the screen count "n" is 4 in the example of FIG. 2 since 4 tags are displayed in the tag portion 92.

The procedure then proceeds to step SP78 at which whether or not the printer 104 supports a "2-up layout" is determined based on print capability information. The 2-up layout is a function to print 2-page print data by reducing it to fit in one page as shown in FIG. 2*b*. If the determination of step SP78 is YES, the procedure proceeds to step SP80 to select a print condition C in which 2-scene image data is printed on one page using the 2-up layout function of the printer 104.

On the other hand, if the determination of step SP78 is NO, the procedure proceeds to step SP82 to select a print condition D in which an image data file containing image data of "2" scenes is created at the electronic musical instrument 100. The procedure then proceeds to step SP84 to determine the resolution of an image data file to be transmitted based on the print condition and the print capability information of the printer 104.

The procedure then proceeds to step SP86 to create print setting information. First, file name list information is created based on the print condition and the number of screen states counted at the above step SP26. For example, if the number of screen states is "4" and the print condition is "C", 4 file names such as "img_C_0001.bmp"~"img_C_0004.bmp" are determined. On the other hand, if the print condition is "D", the number of file names is determined based on "number of scenes"/2 which is rounded up. In the above example, 2 file names such as "img_D_0001.bmp" and "img_D_0001.bmp" are determined since the number of file names is 2(=4/2). In any case, file name list information is created by listing the determined file names. In addition, basic file information is created based on the file format, print format, and resolution determined at steps SP72, SP74, and SP84. If print setting information is created by listing the file name list information, the print condition, and the basic file information, then the procedure of the main routine is terminated.

3.3. Preparation of Image File

A procedure of the image data file preparation subroutine will now be described with reference to FIG. 11. When the procedure of FIG. 11 proceeds to step SP92, it is determined whether or not the print condition C has been selected at the previous steps SP78 to SP82. If this determination is "YES", the procedure proceeds to step SP96. At step SP96, the content of a scene associated with a next tag to be output is converted to image data and the image data is stored in a buffer area in the RAM 22 as an image data file associated with a file name that is previously specified by a file request from the printer 104. Since this embodiment uses a display including a dot matrix formed over its entirety instead of the display 10 of the first embodiment, display image data for displaying images on the display is expressed by on and off states of the dots of the display. The on and off states of the dots are used directly as on and off states of dots in an image data file for transmission to the printer 104 to create the image data file.

On the other hand, if the determination of step SP92 is "NO", the procedure proceeds to step SP94. At step SP94, the content of two scenes corresponding to two tags that constitutes a next image data file is converted to image data and the image data is stored in a buffer area in the RAM 22 as an image data file associated with a file name that is previously specified by a file request from the printer 104. Then, the procedure proceeds to step SP98 to create file information of the image data file. Although the content of the created file information is similar to those in step SP48 of the first embodiment, the file size included in the created file information is the same as that of the image data file created at the above step SP94 or SP96. Through these steps, the procedure of the main routine is terminated.

4. Modified Examples

The present invention is not limited to the above embodiments and can provide a variety of modifications as follows.

(1) Although the print process or the like is performed by a program running on the CPU 26, the program alone may be stored and distributed on a machine readable medium such as a CD-ROM or a flexible disk and may also be distributed through a transmission line.

(2) Although screen states or scenes to be printed are automatically determined at steps SP26 and SP76 of the above embodiments, a print sub-dialog for determining a range to be printed may be displayed on the display 10 so that the user can determine the range to be printed. For example, in the first embodiment, a print start bar number or the like is permitted to be specified. In the same manner, although the print format (color or monochrome) is automatically determined at steps SP24 and SP74, the user may be allowed to select either color or monochrome printing if both the electronic musical instrument 100 and the printer 104 can perform both the color and monochrome printing.

(3) In the procedure of SP8 to SP14 of the main routine of the print process (FIG. 6) and in the image data file preparation subroutines (FIGS. 8 and 11) in the above embodiments, each time one image data file is created, it is transmitted to the printer 104 so that the buffer area can manage even if it is small. However, if a required buffer area can be secured, a plurality of image data files may be collectively created and the files may be sequentially transmitted one by one according to a file request from the printer 104.

(4) In the second embodiment, a plurality of tags is provided in the tag portion 92 to display a wide range of parameters or the like, all of which cannot be displayed at once on the display 10. However, it can be considered that a scroll bar is displayed on the display and the entire range of parameters or the like are displayed by scrolling the screen vertically or horizontally. This is also included in the category of "alternating display of a plurality of scenes" and an image data file is_created based on each scene that is displayed on the display 10 through one or a plurality of scroll actions.

In the second embodiment, on and off states of dots of image data for displaying an image on the display are used directly as on and off states of dots of an image data file for transmission to the printer 104. However, the image data for display on the display may be converted to create an image data file for the printer 104. For example, if the dots on the display are circular, an image data file for the printer 104 may be created by arranging a plurality of circles corresponding to the dots and fill colors (black or white) of the circles may then be selected according to on or off states of the dots on the display.

Figure 12:
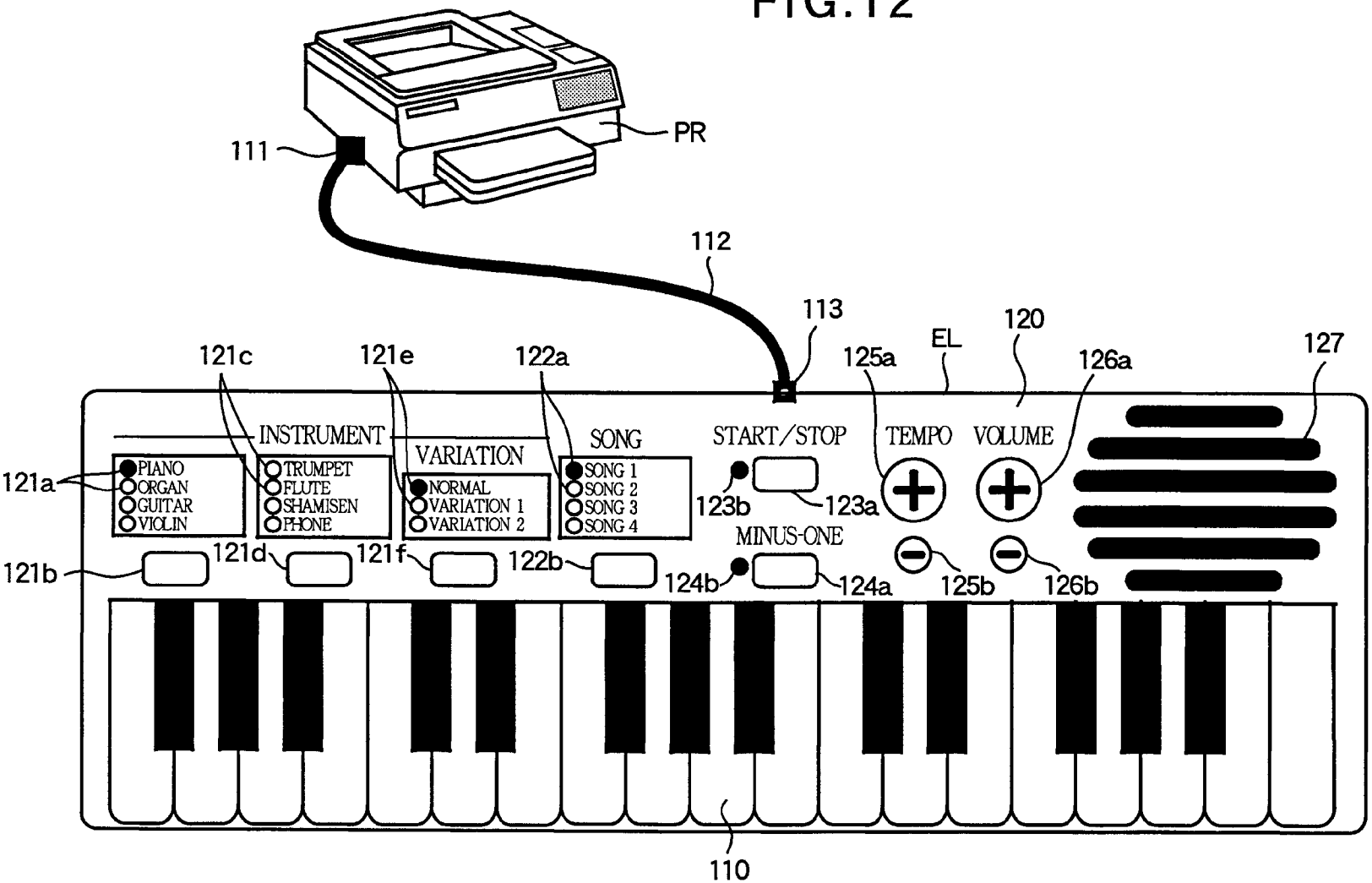
FIG. 12 is a schematic diagram illustrating an electronic musical instrument according to the second aspect of the present invention when it is connected to a printer.

A second aspect of the present invention will be described in detail with reference to FIG. 12 through FIG. 21. FIG. 12 is a conceptual diagram illustrating an electronic musical instrument EL according to the present invention when it is connected to a printer PR. The printer PR is connected to the electronic musical instrument EL through a USB connector 111, a USB cable 112, and a USB connector 113. Respective connector units, to which the USB connectors 111 and 113 are detachably connected, are mounted on the printer PR and the electronic musical instrument EL. When the printer PR is connected to the electronic musical instrument EL, the electronic musical instrument EL functions as a USB device and the printer PR functions as a USB host. The electronic musical instrument EL and the printer PR operate according to the CIPA standard "DC-001" (hereinafter referred to as "PictBridge" (registered trademark) and the printer PR prints an image corresponding to image data from the electronic musical instrument EL. Here, the USB connectors 111 and 113, the USB cable 112, the connector unit of the electronic musical instrument EL, and a USB interface circuit 147 (described later) correspond to a connection part of the invention.

The electronic musical instrument EL includes a keyboard 110 including a plurality of keys and an operating panel 120. Eight main tone names, one of which is to be selected as the tone of a performance sound generated by the keyboard 110, are written on the operating panel 120. Letter strings including "normal", "variation 1", and "variation 2" representing tones, which are similar to those included in the main tone names and are slightly different from one another, are also written on the operating panel 120. The 8 main tone names are divided into a first group of main tone names including "piano", "organ", and the like and a second group of main tone names including "trumpet", "flute", and the like.

Indicator lamps 121*a*, 121*a*, . . . , each including a light emitting element, are embedded at positions of the operating panel 120 where the main tone names included in the first group are written and a first tone selection operator 121*b* is commonly mounted for the main tone names of the first group. Indicator lamps 121*c*, 121*c*, . . . , each including a light emitting element, are embedded at positions of the operating panel 120 where the main tone names included in the second group are written and a second tone selection operator 121*d* is commonly mounted for the main tone names of the second group. Indicator lamps 121*e*, 121*e*, . . . , each including a light emitting element, are embedded at positions of the operating panel 120 where the letter strings including "normal", "variation 1", and "variation 2" are written and a variation selection operator 121*f* is commonly mounted for these letter strings.

In addition, song numbers 1 to 4 corresponding to automatic playing songs to be selected are written on the operating panel 120. Indicator lamps 122*a*, 121*e*, . . . , each including a light emitting element, are embedded at positions of the operating panel 120 where the song numbers 1 to 4 are written and a song selection operator 122*b* is commonly mounted for the song numbers 1 to 4. A start/stop operator 123*a* used to start or stop reproduction of automatic playing (or performance) data is mounted on the operating panel 120 and an indicator lamp 123*b* corresponding to the start/stop operator 123*a*, which includes a light emitting element to indicate whether or not the automatic performance data is currently reproduced, is mounted on the operating panel 120. A minus-one selection operator 124*a* used to exclude one part (for example, a melody part) from the automatic performance is mounted on the operating panel 120 and an indicator lamp 124*b* corresponding to the minus-one operator 124*a*, which includes a light emitting element to indicate whether or not the minus-one function is on, is mounted on the operating panel 120.

A tempo increment operator 125*a*, a tempo decrement operator 125*b*, a volume increment operator 126*a*, a volume decrement operator 126*b*, and a speaker 127 are also mounted on the operating panel 120. The tempo increment operator 125*a* and the tempo decrement operator 125*b* are used to increment and decrement the reproduction tempo of the automatic performance. The volume increment operator 126*a* and the volume decrement operator 126*b* are used to increment and decrement the volume of a generated musical sound.

Figure 13:
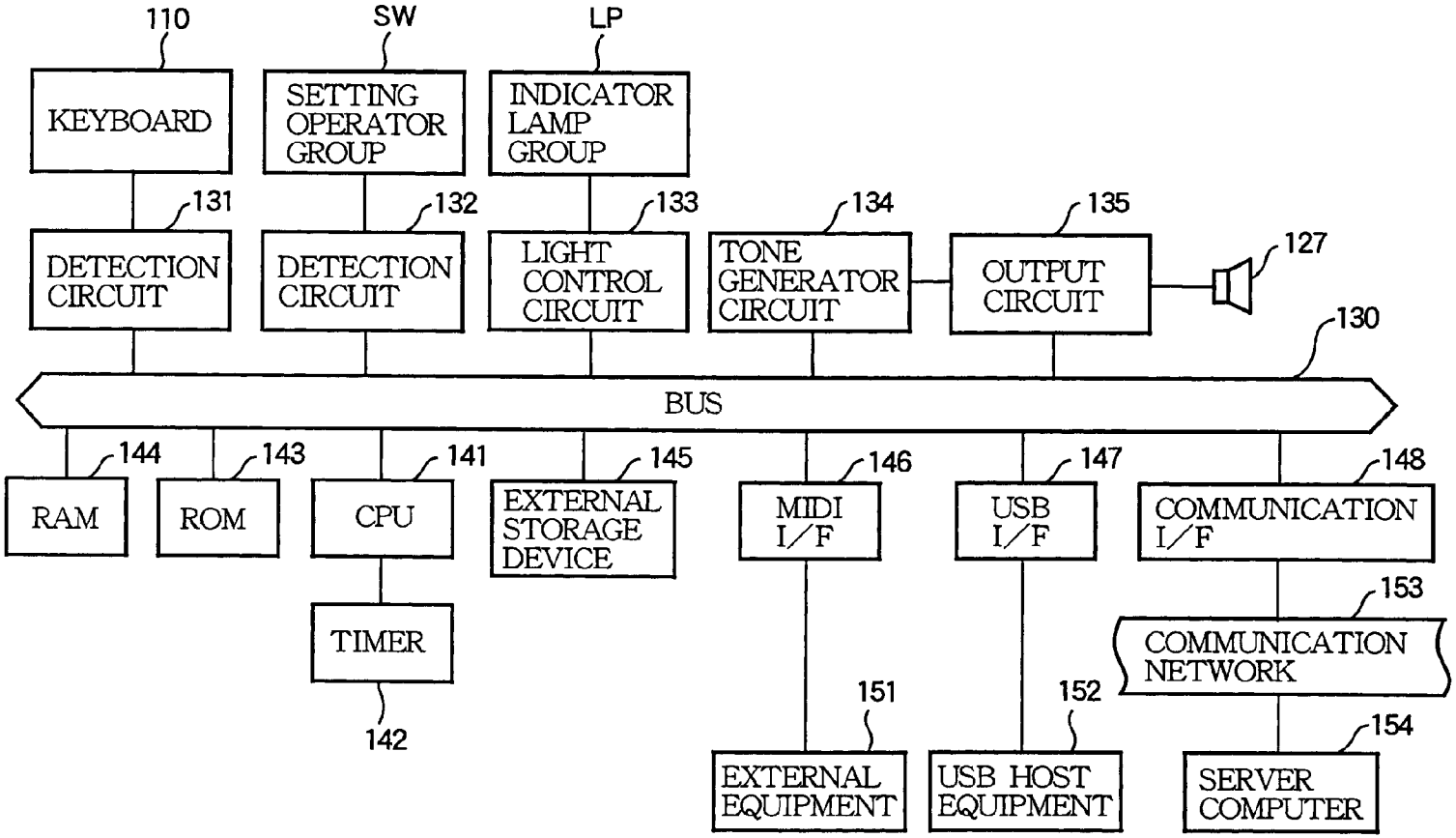
FIG. 13 is an overall block diagram of the electronic musical instrument.

A circuit device incorporated into the electronic musical instrument EL will now be described with reference to FIG. 13. Detection circuits 131 and 132, a light control circuit 133, and a tone generator circuit 134, which are connected to a bus 130, are provided in the electronic musical instrument EL. The detection circuit 131 detects a variety of key operations of the keyboard 110. The detection circuit 132 detects operations of the variety of operators l21*b*, 121*d*, 121*f*, 122*b*, 123*a*, 124*a*, 125*a*, 125*b*, 126*a*, and 126*b*, which are collectively shown as a setting operator group SW in FIG. 13. The light control circuit 133 controls on and off states of the variety of indicator lamps 121*a*, 121*c*, 121*e*, 122*a*, 123*b*, and 124*b*, which are collectively shown as an indicator lamp group LP in FIG. 13.

The tone generator circuit 134 generates a digital musical sound signal based on a variety of musical sound control parameters and performance (or playing) data provided under the control of a CPU 141 which will be described later and outputs the generated digital musical sound signal to an output circuit 135. The output circuit 135 includes a D/A converter and an amplifier and converts a received digital musical sound signal into an analog musical sound signal and amplifies and outputs it to the speaker. The speaker 127 generates a musical sound corresponding to the analog musical sound signal.

The electronic musical instrument also includes a CPU 141, a timer 142, a ROM 143, and a RAM 144 which constitute the main body of a microcomputer and which are connected to the bus 130. The electronic musical instrument also includes an external storage device 145, a MIDI interface device 146, a USB interface circuit 147, and a communication interface device 148.

The external storage device 145 includes a hard disk (HD) and a flash memory which were previously incorporated into the electronic musical instrument, a variety of recording media such as a compact disc (CD) and a flexible disk (FD) that can be loaded into the electronic musical instrument, and respective drive units of the storage media. The external storage device 145 allows reading and storage of data and programs described later. The data and programs may be previously stored in the external storage device 145 and may also be received from the outside through the MIDI interface device 146 and the communication interface device 148. A variety of data and programs are also previously stored in the ROM 143. When the operation of the electronic musical instrument EL is being controlled, a variety of data and programs are transmitted from the ROM 143 or the external storage device 145 to the RAM 144 so that they are stored in the RAM 144.

Figure 14:
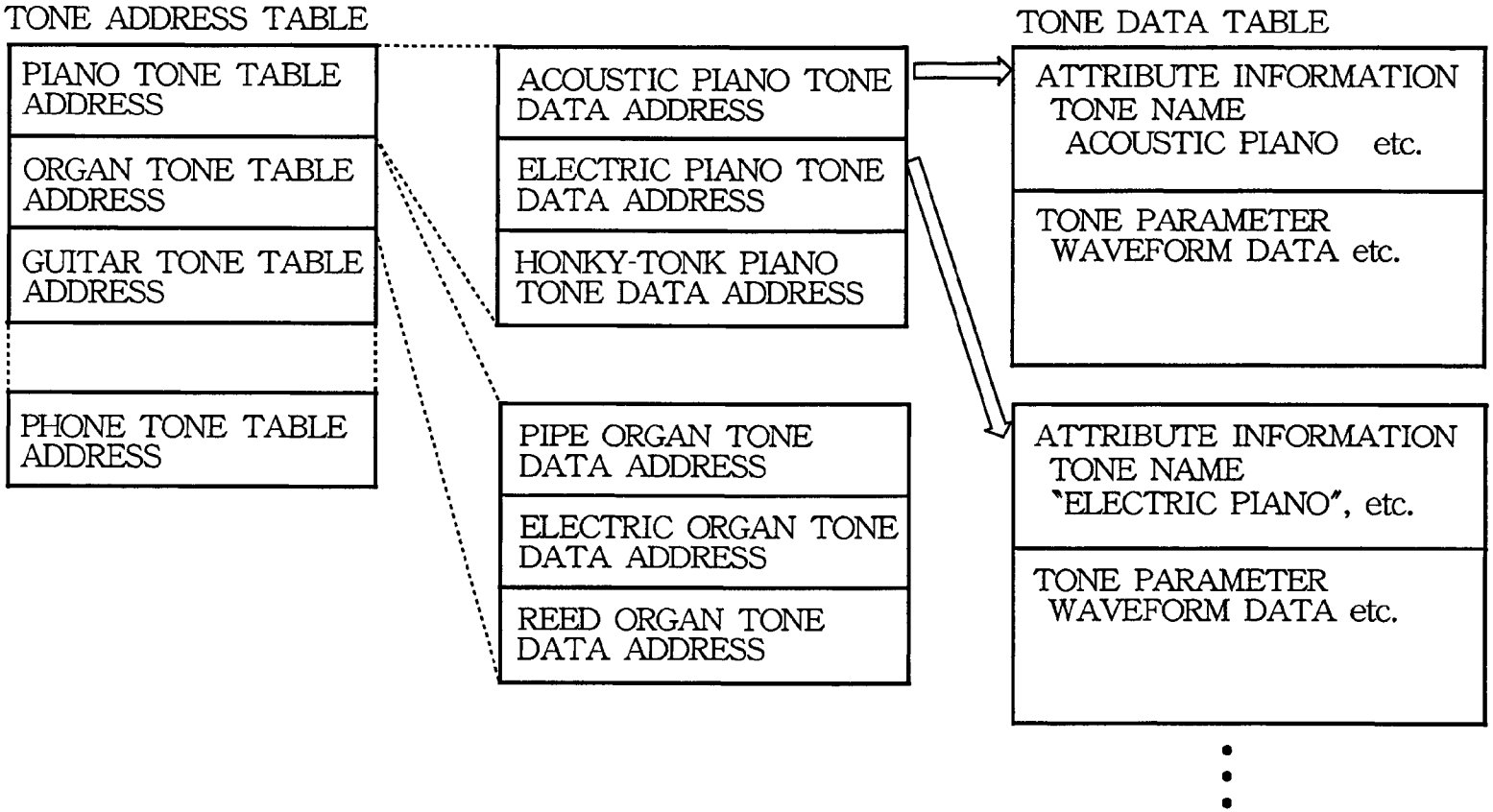
FIG. 14 is a format diagram of a tone address table and a tone data table provided in the electronic musical instrument.
Figure 15:
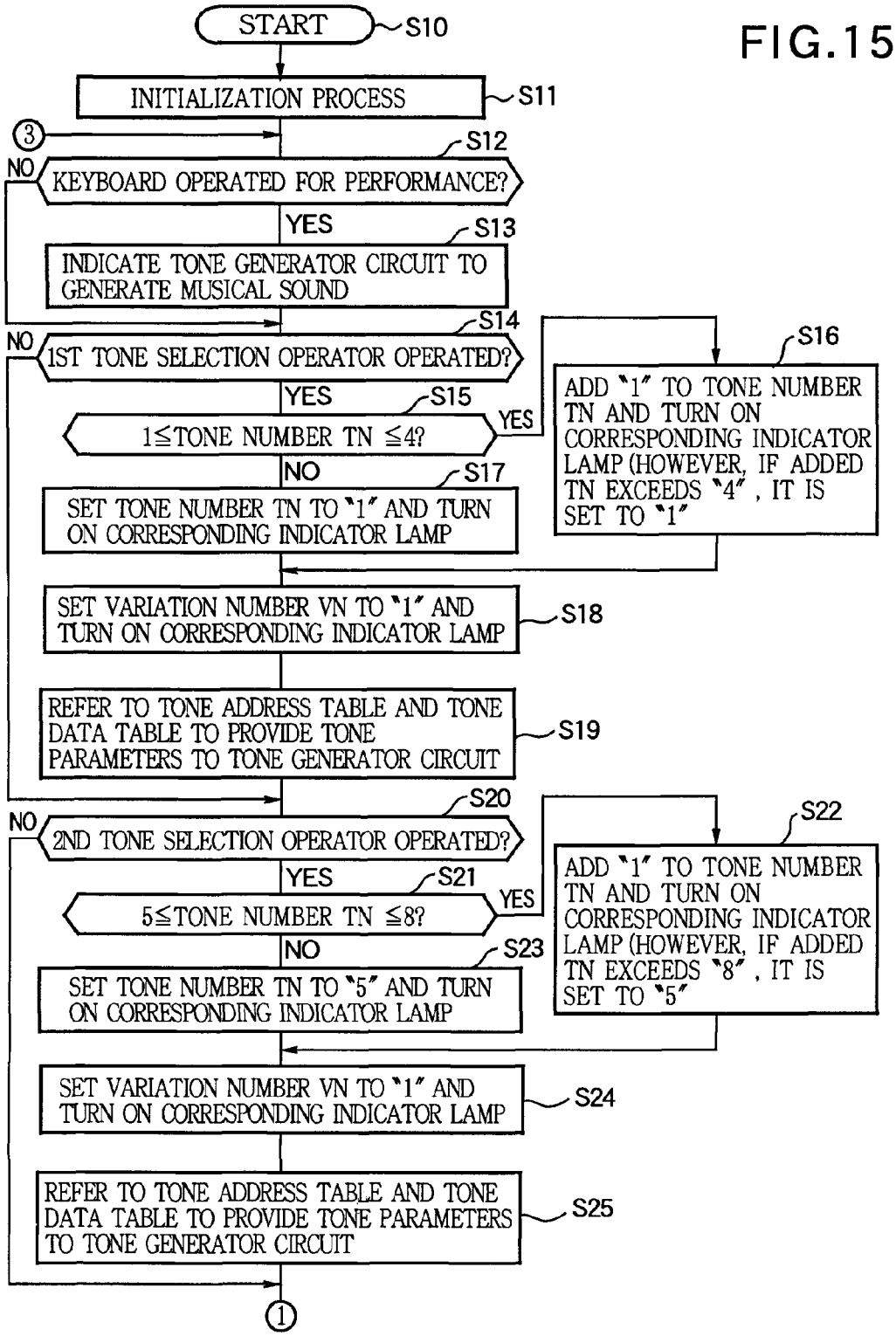
FIG. 15 is a flow chart illustrating a front part of a program executed on the electronic musical instrument.

Tone control parameters according to the invention will now be described. A tone address table and a tone data table are previously stored in the ROM 143 or the external storage device 145 as shown in FIG. 14. The tone address table includes respective fields of the main tones "piano", "organ", . . . , and "phone" included in the first and second groups, each of which is divided into subfields "normal", "variation 1", and "variation 2". Each field of the tone address table stores an address in the tone data table at which corresponding tone data is stored. In addition, "acoustic piano", "electric piano", and "honky-tonk piano" shown in the center of FIG. 14 are tones corresponding respectively to "normal", "variation 1", and "variation 2" included in the main tone "piano". Further, "pipe organ", "electric organ", and "reed organ" are tones corresponding respectively to "normal", "variation 1", and "variation 2" included in the main tone "organ". The tone data table includes respective fields of the main tones "piano", "organ", . . . , and "phone" included in the first and second groups, each of which is divided into subfields "normal", "variation 1", and "variation 2". Each field of the tone data table stores both attribute information such as a tone name and tone parameters which are part of musical sound control parameters including waveform data or the like.

In addition, automatic performance data of 4 songs specified by the song numbers 1 to 4 are previously stored in the ROM 143 or the external storage device 145. Panel image data representing the appearance of the operating panel 120 including the variety of operators 121*b*, 121*d*, 121*f*, 122*b*, 123*a*, 124*a*, 125*a*, 125*b*, 126*a*, and 126*b* and the variety of indicator lamps 121*a*, 121*c*, 121*e*, 122*a*, 123*b*, and 124*b* are also previously stored in the ROM 143 or the external storage device 145.

The MIDI interface device 146 can be connected to MIDI-enabled external equipment 151 such as another electronic musical instrument or a personal computer so that this electronic musical instrument can communicate a variety of programs and data with the external equipment 151. The USB interface circuit 147 is connected to the USB connector 113 whereby it is connected to USB host equipment 152. In this embodiment, the USB interface circuit 147 is connected to a printer PR as the USB host equipment 152 through the USB connector 113, the USB cable 112, and the USB connector 111. The communication interface device 148 can be connected to a server computer 154 through a communication network 153 such as the Internet so that this electronic musical instrument can receive and transmit a variety of programs and data from and to the server computer 154.

The operation of the electronic musical instrument configured as described above will now be described. When a performer (user) turns on a power switch (not shown) of the electronic musical instrument, the CPU 141 starts a procedure for executing a program shown in FIGS. 15 to 17 at step S10 of FIG. 15. After the CPU 141 starts executing the program, the CPU 141 initializes hardware and software modules and also secures, in the RAM 144, areas for storing variables such as a tone number TN, a song number SN, a variation number VN, a playing flag PF, a minus-one flag MF, a tempo value TMP, and a volume value VOL and sets the variables to default values.

The tone number TN varies over a range from "1" to "8" to specify the main tone of a musical sound generated by playing the keyboard 110 and is initially set to "1". The values "1" to "4" of tone number TN specify the first main tones "piano", "organ", . . . , and "5" to "8" specify the second main tones "trumpet", "flute", . . . . The song number SN varies over a range from "1" to "4" to specify automatically played songs (Song 1, Song 2, . . . ) and is initially set to "1". The variation number VN varies over a range from "1" to "3" to specify "normal", "variation 1", and "variation 2" and is initially set to "1". A value of "0" of the playing flag PF indicates that automatic performance is currently inactive and "1" indicates that automatic performance is currently active. The playing flag PF is initially set to "0". A value of "0" of the minus-one flag MF specifies normal reproduction of the automatic performance and "1" specifies minus-one reproduction of the automatic performance. The minus-one flag MF is initially set to "0". The tempo value TMP varies over a range from "30" to "240" to specify the tempo of automatic performance and is initially set to "120". The volume value "VOL" varies over a range from "0" to "127" to specify the volume of a generated musical sound and is initially set to "64".

After the initial setting process of step S11, the CPU 141 repeatedly performs an iterative procedure of steps S12 to S50. When the keyboard 110 is operated for a performance during the iterative procedure, the CPU 141 determines "Yes" at step S12 and provides performance data according to the performance of the keyboard and instructs the tone generator circuit 134 to generate a musical sound at step S13. Accordingly, the tone generator circuit 134 generates a digital musical sound signal according to the provided performance data and outputs it to the output circuit 135. In this case, the tone and volume of the musical sound signal generated by the tone generator circuit 134 is determined by a tone parameter and a volume value VOL provided to the tone generator circuit 134. The output circuit 135 converts the digital musical sound signal into an analog musical sound signal and generates a musical sound corresponding to the analog musical sound signal through the speaker 127.

When the first tone selection operator 121*b* is operated, the CPU 141 determines "Yes" at step S14 and performs a procedure of steps S15 to S19. If the current tone number TN is in a range from "1" to "4" ($1 \leqq TN \leqq 4$), the CPU 141 adds "1" to the tone number TN and turns on an indicator lamp 121*a* at the position of a main tone name corresponding to the added tone number TN from among the 8 indicator lamps 121*a* and 121*c* and turns off the other indicator lamps 121*a* and 121*c* through a procedure of steps S15 and S16. However, if the added tone number TN is greater than "4", the CPU 141 sets the tone number TN to "1" and turns on an indicator lamp 121*a* at the position of the main tone name "piano" whose tone number TN is "1" from among the 8 indicator lamps 121*a* and 121*c* and turns off the other indicator lamps 121*a* and 121*c*. If the current tone number TN is not in the range from "1" to "4", the CPU 141 sets the tone number TN to "1" and turns on an indicator lamp 121*a* at the position of the main tone name "piano" whose tone number TN is "1" from among the 8 indicator lamps 121*a* and 121*c* and turns off the other indicator lamps 121*a* and 121*c* through a procedure of steps S15 and S17.

At step S18, the CPU 141 sets the variation number VN to "1" and turns on the indicator lamp 122*a* at the "normal" position whose variation number VN is "1" from among the 3 indicator lamps 122*a* and turns off the other indicator lamps 122*a*. At step S19, the CPU 141 refers to the tone address table and the tone data table (see FIG. 14) and reads tone parameters corresponding to the tone number TN and the variation number VN from the tone data table and provides the tone parameters to the tone generator circuit 134. The tone generator circuit 134 stores the provided tone parameters and specifies a tone of a musical sound, which is afterwards played on the keyboard 110, using the tone parameters.

When the second tone selection operator 121*d* is operated, the CPU 141 determines "Yes" at step S20 and performs a procedure of steps S21 to S25. If the current tone number TN is in a range from "5" to "8" ($5 \leqq TN \leqq 8$), the CPU 141 adds "1" to the tone number TN and turns on an indicator lamp 121*c* at the position of a main tone name corresponding to the added tone number TN from among the 8 indicator lamps 121*a* and 121*c* and turns off the other indicator lamps 121*a* and 121*c* through a procedure of steps S21 and S22. However, if the added tone number TN is greater than "8", the CPU 141 sets the tone number TN to "5" and turns on an indicator lamp 121*c* at the position of the main tone name "trumpet" whose tone number TN is "5" from among the 8 indicator lamps 121*a* and 121*c* and turns off the other indicator lamps 121*a* and 121*c*. If the current tone number TN is not in the range from "5" to "8", the CPU 141 sets the tone number TN to "5" and turns on an indicator lamp 121*a* at the position of the main tone name "trumpet" whose tone number TN is "5" from among the 8 indicator lamps 121*a* and 121*c* and turns off the other indicator lamps 121*a* and 121*c* through a procedure of steps S21 and S23.

At step S24, the CPU 141 sets the variation number VN to "1" and turns on only the indicator lamp 122*a* at the "normal" position whose variation number VN is "1" and turns off the other indicator lamps 122*a* in the same manner as the above process of step S18. At step S25, the CPU 141 refers to the tone address table and the tone data table (see FIG. 14) and reads tone parameters corresponding to the tone number TN and the variation number VN from the tone data table and provides the tone parameters to the tone generator circuit 134 in the same manner as the above process of step S19. Through such a procedure of steps S14 to S25, the CPU 141 selects one of the 8 main tones and specifies a "normal" tone of the selected main tone according to operations of the first and second tone selection operators 121*b* and 121*d*. The CPU 141 also switches the on/off states of the indicator lamps 121*a*, 121*c*, and 121*e* in response to the specification of the tone.

When the variation selection operator 121*f* is operated, the CPU 141 determines "Yes" at step S26 of FIG. 16 and adds "1" to the variation number VN and turns on an indicator lamp 121*e* at the "variation 1" or "variation 2" position corresponding to the added variation number VN from among the 3 indicator lamps 121*e* and turns off the other indicator lamps 121*e* at step S27. However, if the added variation number VN is greater than "3", the CPU 141 sets the variation number VN to "1" and turns on an indicator lamp 121*e* at the "normal" position and turns off the other indicator lamps 121*e*.

At step S28, the CPU 141 refers to the tone address table and the tone data table (see FIG. 14) and reads tone parameters corresponding to the tone number TN and the variation number VN from the tone data table and provides the tone parameters to the tone generator circuit 134 in the same manner as the above process of step S19 or S25. Through such a procedure of steps S26 to S28, the CPU 141 specifies a "normal", "variation 1", or "variation 2" tone of one of the 8 main tones selected according to operations of the first and second tone selection operators 121*b* and 121*d*. The CPU 141 also switches the on/off states of the indicator lamps 121*e* in response to the specification of the tone.

When the song selection operator 122*b* is operated, the CPU 141 determines "Yes" at step S29 and adds "1" to the song number SN and turns on an indicator lamp 122*a* at the position of one of the "song 2", "song 3", and "song 4" corresponding to the added song number SN from among the 4 indicator lamps 122*a* and turns off the other indicator lamps 122*a* at step S30. However, if the added song number SN is greater than "4", the CPU 141 sets the song number SN to "1" and turns on an indicator lamp 122*a* at the "song 1" position and turns off the other indicator lamps 122*a*.

Then, at step S31, the CPU 141 reads automatic performance data specified by the song number SN from among automatic performance data of 4 songs stored in the ROM 143 or the external storage device 145 and transmits the read data to the RAM 144 to store it in the RAM 144. In this manner, specific automatic performance data is selected according to the operation of the song selection operator 122*b* and thus the preparation for reproduction of the automatic performance is completed. The CPU 141 also turns on an indicator lamp 122*a* corresponding to the selected automatic performance data.

If the start/stop operator 123*a* is operated when the performance flag PF is "0" (i.e., when the automatic performance data is not being reproduced), the CPU 141 determines "Yes" at step S32 and performs a procedure of steps S33 to S35. At step S33, the CPU 141 sets the performance flag PF to the value "1" which indicates that the automatic performance data is being reproduced. At step S34, the CPU 141 turns on the indicator lamp 123*b* to indicate that the automatic performance data is being reproduced. At step S35, the CPU 141 initiates the reproduction of the automatic performance data. Accordingly, the CPU 141 executes a performance data reproduction program (not shown), whereby the automatic performance data transmitted to the RAM 144 through the above process of step S31 is read as the music proceeds and the read data is provided to the tone generator circuit 134, thereby reproducing the automatic performance data specified by the song number SN.

On the other hand, if the start/stop operator 123*a* is operated when the performance flag PF is "1" (i.e., when the automatic performance data is being reproduced) or if the read part of the automatic performance data reaches the end of the music, the CPU 141 determines "Yes" at step S36 and performs a procedure of steps S37 to S39. At step S37, the CPU 141 sets the performance flag PF to the value "0" which indicates that the automatic performance data is not being reproduced. At step S38, the CPU 141 turns off the indicator lamp 123*b* to indicate that the automatic performance data is not being reproduced. At step S39, the CPU 141 stops the reproduction of the automatic performance data. This stops the reading of the automatic performance data through the performance data reproduction program, thereby terminating the automatic performance.

When the minus-one selection operator 124*a* is operated, the CPU 141 determines "Yes" at step S40 and performs a procedure of steps S41 and S42. At step S41, the CPU 141 toggles the minus-one flag MF. That is, if it is "0", the CPU 141 changes the minus-one flag MF to "1" and, if it is "1", the CPU 141 changes the minus-one flag MF to "0". At step S42, the CPU 141 turns on the indicator lamp 124*b* if the changed minus-one flag MF is "1" and turns off the indicator lamp 124*b* if the changed minus-one flag MF is "0", thereby indicating the reproduction state (activation or deactivation of the minus-one function) of the automatic performance data. If the operation of the minus-one selection operator 124*a* causes the minus-one flag to be set to "0", all parts of the automatic performance data are reproduced. On the other hand, if its operation causes the minus-one flag to be set to "1", parts of the automatic performance data, excluding one part (for example, a melody part), are reproduced.

Figure 17:
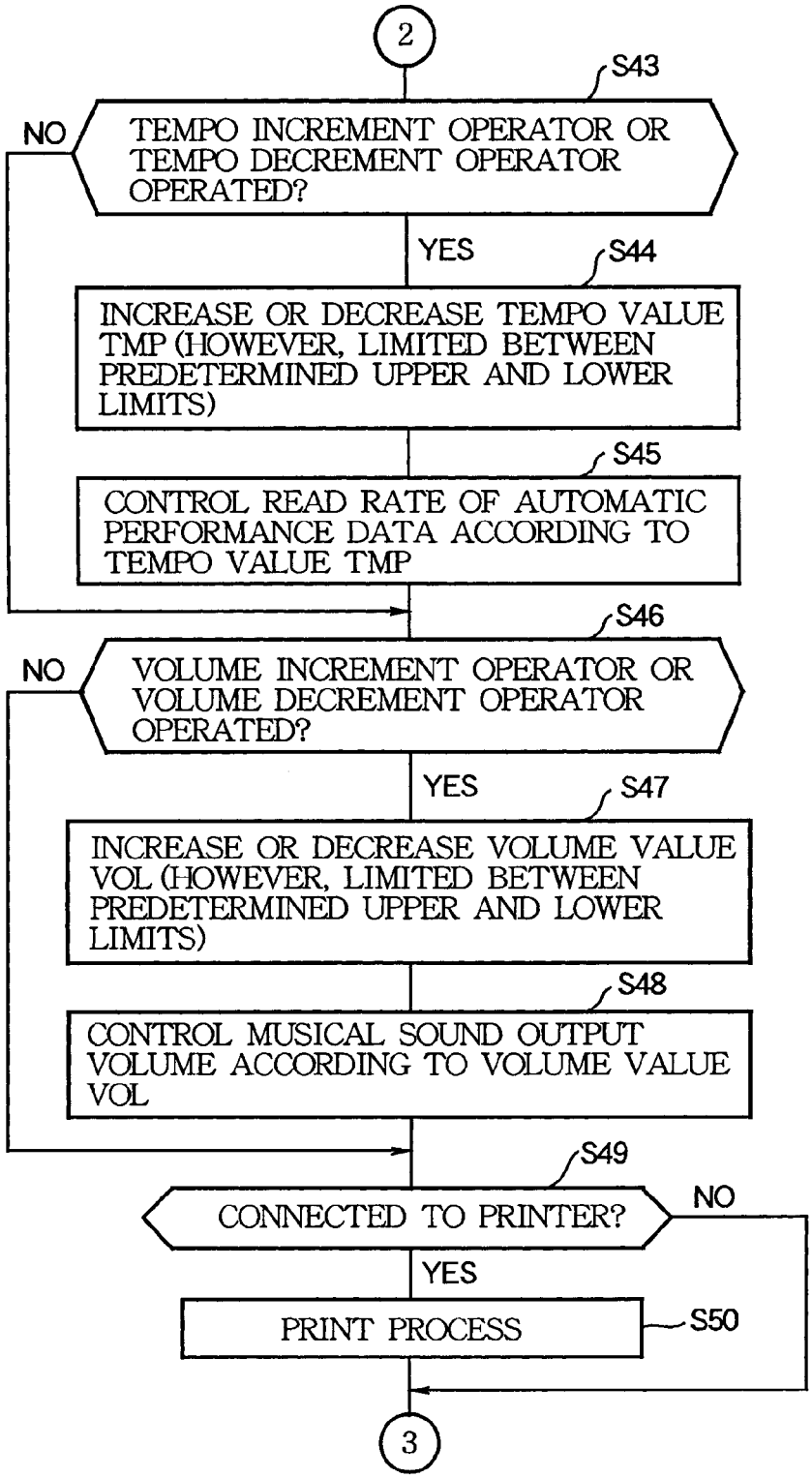
FIG. 17 is a flow chart illustrating a rear part of the program.

When the tempo increment operator 125*a* or the tempo decrement operator 125*b* is operated, the CPU 141 determines "Yes" at step S43 of FIG. 17 and performs a procedure of steps S44 and S45. At step S44, if the tempo increment operator 125*a* is operated singly, the CPU 141 increases the tempo value TMP by "1" per operation. If the tempo increment operator 125*a* is operated continuously, the CPU 141 continuously increases the tempo value TMP at specific time intervals. If the tempo decrement operator 125*b* is operated singly, the CPU 141 decreases the tempo value TMP by "1" per operation. If the tempo decrement operator 125*b* is operated continuously, the CPU 141 continuously decreases the tempo value TMP at specific time intervals. However, the increase and decrease of the tempo value TMP are limited between lower and upper limits of "30" and "240".

At step S45, the CPU 141 sets the change rate (or speed) of a tempo count value (not shown) used by a performance data reproduction program (not shown) to a value corresponding to the tempo value TMP so that the rate at which the performance data reproduction program reads the automatic performance data is specified by the tempo value TMP. Accordingly, the reproduction rate of the automatic performance data is changed according to the operation of the tempo increment operator 125*a* or the tempo decrement operator 125*b*.

When the volume increment operator 126*a* or the volume decrement operator 126*b* is operated, the CPU 141 determines "Yes" at step S46 and performs a procedure of steps S47 and S48. At step S47, if the volume increment operator 126*a* is operated singly, the CPU 141 increases the volume value VOL by "1" per operation. If the volume increment operator 126*a* is operated continuously, the CPU 141 continuously increases the volume value VOL at specific time intervals. If the volume decrement operator 126*b* is operated singly, the CPU 141 decreases the volume value VOL by "1" per operation. If the volume decrement operator 126*b* is operated continuously, the CPU 141 continuously decreases the volume value VOL at specific time intervals. However, the increase and decrease of the volume value VOL are limited between lower and upper limits of "0" and "127".

At step S48, the CPU 141 provides the set volume value VOL to the tone generator circuit 134. The tone generator circuit 134 controls the volume of a generated digital musical sound signal to the volume value VOL. Accordingly, the volume of the digital musical sound signal output from the tone generator circuit 134 and therefore the volume of a musical sound generated by the speaker 127 are controlled according to the set volume value VOL.

Figure 18:
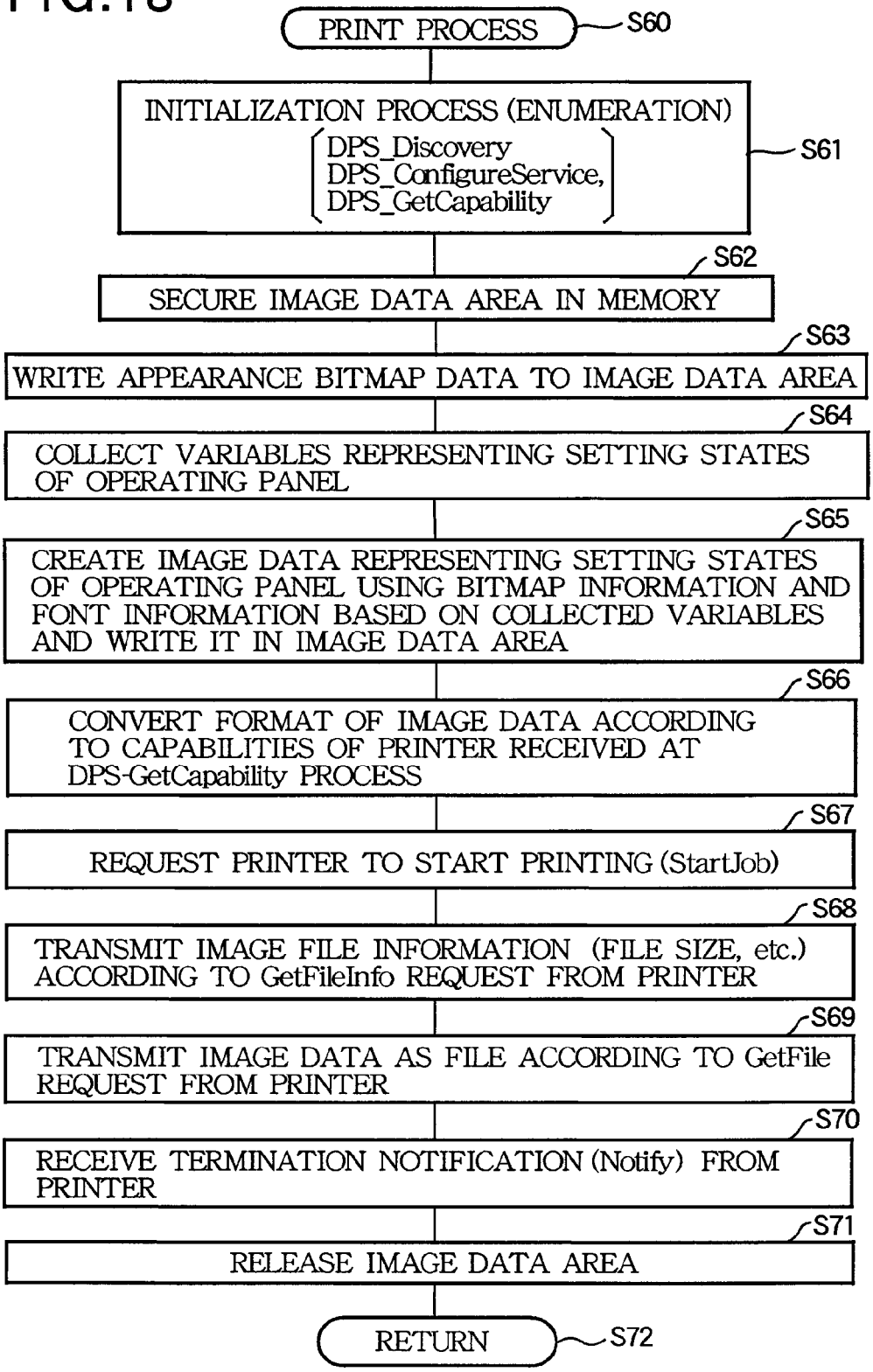
FIG. 18 is a flow chart illustrating details of the print process routine of FIG. 17.

When the printer PR is connected to the electronic musical instrument EL, the CPU 141 determines "Yes" at step S49 and performs a print process routine at step S50, provided that the power of each of the printer PR and the electronic musical instrument EL is on. FIG. 18 shows details of the print process routine. The CPU 141 starts this process at step S60. After starting the print process routine, the CPU 141 performs an initialization process (i.e., enumeration) according to the USB specifications at step S61.

Specifically, according to the PictBridge (registered trademark) specifications, each of the electronic musical instrument EL and the printer PR checks whether or not each other is a PictBridge-enabled device (DPS-Discovery). Then, the electronic musical instrument EL as a print client requests the printer PR to provide a print-service function and notifies the printer PR that it has a storage-service function (DPS-ConfigurePrintService). In response to this, the printer PR notifies the electronic musical instrument EL that it can provide a print-service function and that it uses the storage-service function. The relationship between the print-related server/client and the storage-related server/client is established through these processes. Then, the electronic musical instrument EL queries the printer PR about its settable capabilities, i.e., its printable formats (for example, bitmap format, JPEG format, etc.) and receives such formats from the printer PR (DPS-GetCapability).

The CPU 141 then secures an image data area in the RAM 144 at step S62. At step S63, the CPU 141 reads panel image data representing an appearance of the operating panel 120 previously stored in the ROM 143 or the external storage device 145 and writes appearance bitmap data for displaying the operating panel 120 using the panel image data to the image data area. Then, at step S64, the CPU 141 collects variables representing the setting states of the operating panel 120, which include a tone number TN, a song number SN, a variation number VN, a performance flag PF, a minus-one flag MF, a tempo value TMP, and a volume value VOL. Then, at step S65, based on the collected variables, the CPU 141 creates image data representing the setting states of the operating panel 120 using bitmap information and font information and writes the image data to the image data area. The image data includes image data representing markers representing the selected main tone, variation, and automatic playing song, and the like, image data representing on and off states of the indicator lamps 123*b* and 124*b*, image data representing numbers (characters) representing the tempo value TMP and the volume value VOL. At step S66, the CPU 141 converts the format of the image data written in the image data area according to the capabilities of the printer PR received through the initialization process (DPS-GetCapability).

Then, at step S67, the CPU 141 requests the printer PR to start printing (Start-Job). Then, at step S68, the CPU 141 transmits image file information (the file size, etc.) according to a Get-File-Info request from the printer PR. At step S69, the CPU 141 transmits, as a file, the image data written in the image data area according to a Get-File request from the printer PR.

Figure 19:
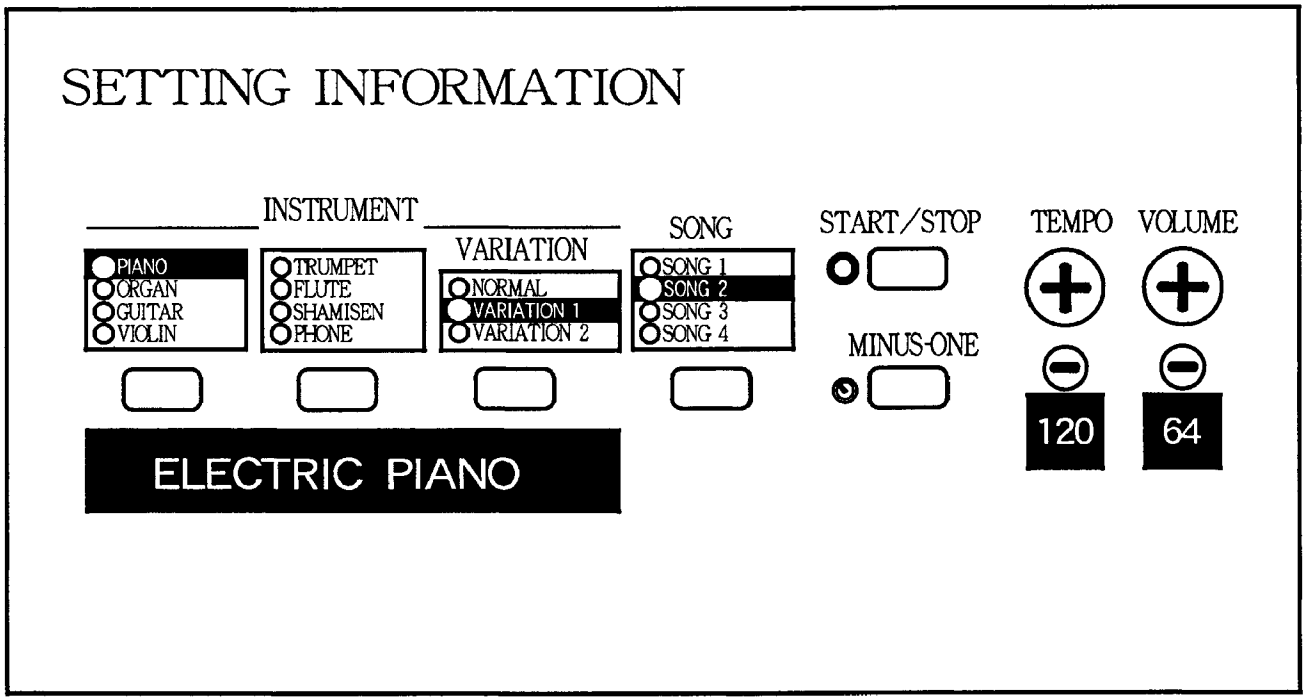
FIG. 19 is a diagram illustrating an example printout which represents setting states of an operating panel.
Figure 20:
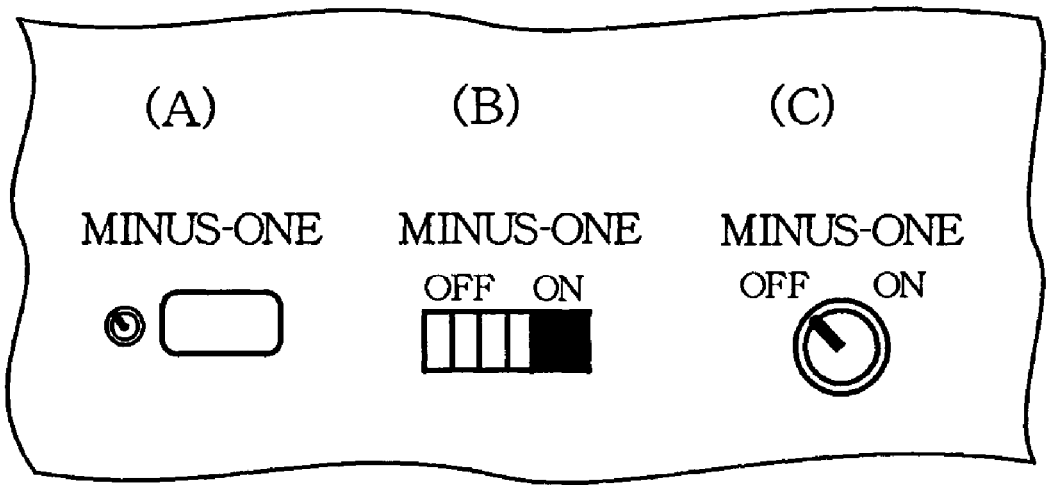
FIG. 20 is a schematic diagram illustrating an operator selected from operators in FIG. 12 and illustrating modified examples thereof.

Based on the image data transmitted from the electronic musical instrument EL, the printer PR prints an image representing the setting states of the operating panel 120 that are represented by the image data. FIG. 19 illustrates an example printout of the image representing the setting states of the operating panel 120. In this manner, the selected main tone, variation, automatic playing song, and the like are printed and displayed as characters and markers (which are highlighted by reversing black and white portions of the characters). The on and off states of the indicator lamps 123*b* and 124*b* corresponding to the start/stop operator 123*a* and the minus-one selection operator 124*a* are printed and displayed. The tempo value TMP and the volume value VOL are displayed as numbers in association with the tempo increment operator 125*a*, the tempo decrement operator 125*b*, the volume increment operator 126*a*, and the volume decrement operator 126*b*.

When the printer PR terminates the printing, the CPU 141 receives a termination notification (Notify) from the printer PR at step S70 and releases the image data area defined in the RAM 144 at step S71 and terminates the print process routine at step S72.

In the above embodiment, the printer PR is connected to the electronic musical instrument EL through the USB cable 112 to print an image representing setting states of the operating modes of the electronic musical instrument EL which have been set using the variety of operators 121*b*, 121*d*, 121*f*, 122*b*, 123*a*, 124*a*, 125*a*, 125*b*, 126*a*, and 126*b* on the operating panel 120 as is apparent from the above description of the operation. Thus, according to the above embodiment, the user can easily check the setting states of the operating modes set using the variety of operators and can also easily query the manufacturer about operations of the electronic musical instrument EL by sending the printed material to the manufacturer via facsimile. This is very effective for an electronic musical instrument EL that has no screen display function to display its setting states set using setting operators. In addition, the above embodiment does not require complex operations since the printer PR can be used by connecting it directly to the electronic musical instrument EL and there is no need to use a personal computer or the like for the connection.

The present invention is not limited to the above embodiment and various modifications are possible without departing from the object of the invention.

Although 8 main tones, 3 variations, and 4 automatic performance songs are employed in the above embodiment, greater or less numbers of ones may be used. In addition, although selection of effects such as tremolo and chorus on this electronic musical instrument is not described above, operators for selecting such effects may be mounted on the operating panel so that selection states of the effects can be printed.

Further, although the indicator lamps 121*a*, 121*c*, 121*e*, 122*a*, 123*b*, and 124*b* are provided in association with the selection operators 121*b*, 121*d*, 121*f*, 122*b*, 123*a*, and 124*a* of main tones, variations, and automatic playing songs, and reproduction and minus-one functions of automatic playing in the above embodiment, indicator lamps corresponding to all or part of the selection operators may be omitted. For example, the indicator lamps 121*a*, 121*c*, 121*e*, and 122*a* corresponding to the selection operators 121*b*, 121*d*, 121*f*, and 122*b* of the main tones, variations, and automatic playing songs may be omitted. Even when these are omitted, selection states of the main tone, variation, and automatic playing song using the selection operators 121*b*, 121*d*, 121*f*, and 122*b* can be confirmed through the example printout shown in FIG. 19.

In addition, although momentary (on/off) switches are provided as the operators 121*b*, 121*d*, 121*f*, 122*b*, 123*a*, 124*a*, 125*a*, 125*b*, 126*a*, and 126*b* in the above embodiment, other types of operators may be used. For example, the minus-one selection operator 124*a* of the above embodiment shown in FIG. 20(A) may be constructed using alternating switches shown in FIG. 20(B) or rotary switches shown in FIG. 20(C). In this case, image data representing the appearance of the alternating switch of FIG. 20(B) or the rotary switch of FIG. 20(C) is prepared as image data representing the appearance of the operating panel 120. In this case, an image of the alternating switch of FIG. 20*b* or the rotary switch of FIG. 20(C) with an image representing the setting state of the switch added thereto is printed.

Further, in the above embodiment, the setting states of the operating panel 120 are printed and displayed using an image representing the appearance of the operating panel 120. However, alternatively, the setting states of the operating panel may be printed and displayed as characters as shown in FIG. 21. In this case, the CPU 141 creates image data representing characters or numbers representing the setting states of the operating panel 120 as shown in FIG. 21 and then transmits the image data to the printer PR. This eliminates the need to provide the image data representing the appearance of the operating panel and also makes it easy to create and print the image data representing the setting states of the operating panel 120.

Moreover, in the above embodiment, the setting states of the operating panel 120 are automatically printed when the printer PR is connected to the electronic musical instrument EL. However, alternatively or additionally, the setting states of the operating panel 120 may be printed by a print instruction operation which the user performs on the electronic musical instrument EL or the printer PR.

In addition, although the invention is applied to the electronic musical instrument EL that uses the keyboard 110 as a performance operator, the invention may be applied to an electronic musical instrument that uses simple depression switches, touch switches, and the like rather than the keyboard as a performance operator for specifying the pitch. Particularly, the invention can be applied to any type of electronic musical instrument such as an electronic string instrument or an electronic wind instrument.

Figure 22:
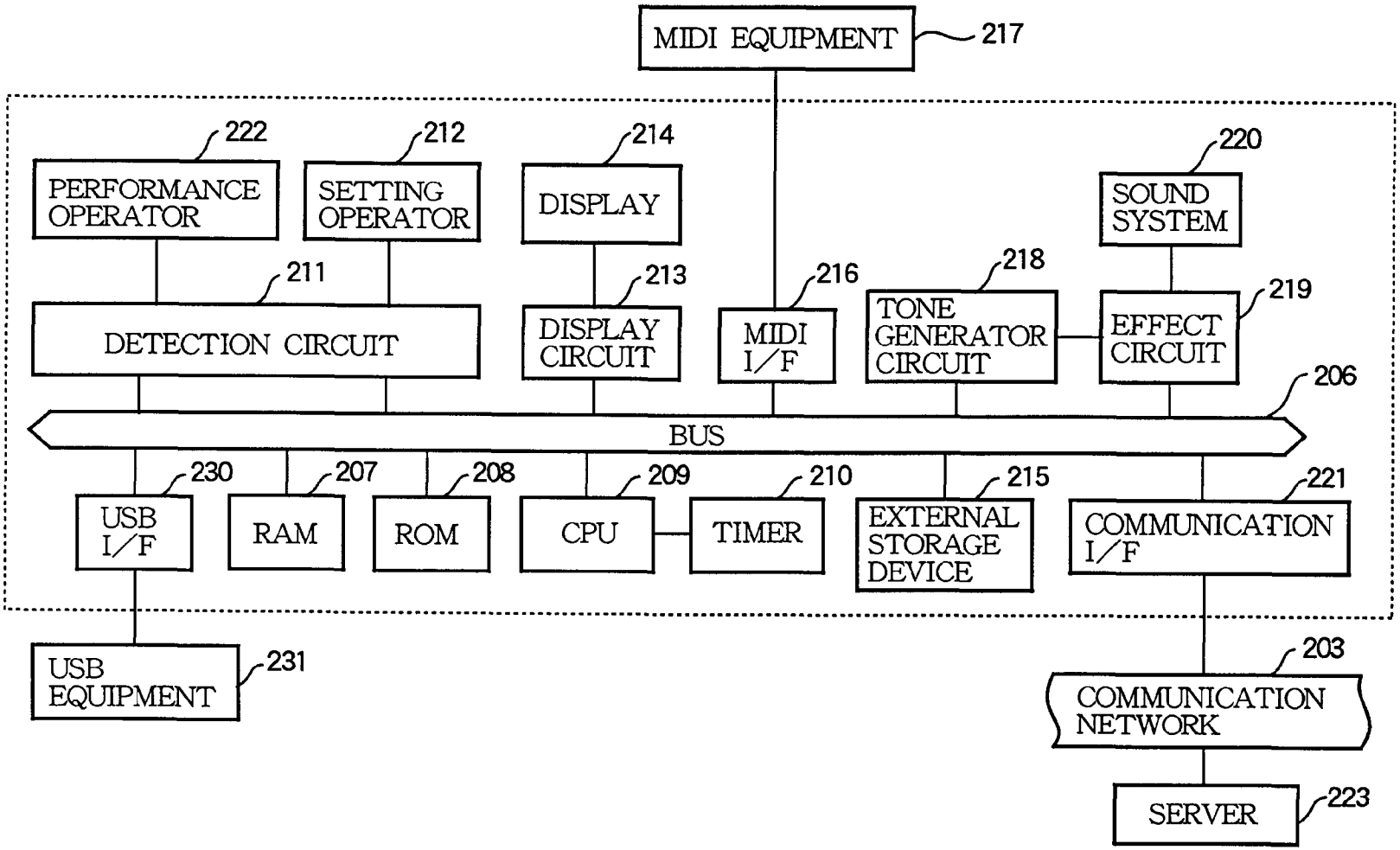
FIG. 22 is a block diagram illustrating a hardware structure of an electronic musical instrument according to the third aspect of the present invention.

A third aspect of the present invention will be described in detail with reference to FIG. 22 through FIG. 27. FIG. 22 is a block diagram illustrating a hardware structure of an electronic musical instrument 200 according to an embodiment of the present invention.

The electronic musical instrument 200 includes a performance operator (for example, a keyboard or a pad) through which a user can play a performance. The electronic musical instrument 200 may be any device provided that it is a device specialized for music processing such as a tone generator device or a mixer.

The electronic musical instrument 200 includes a bus 206, a RAM 207, a ROM 208, a CPU 209, a timer 210, a detection circuit 211, a setting operator 212, a performance operator 222, a display circuit 213, a display 214, an external storage device 215, a MIDI interface 216, a music source circuit 218, an effect circuit 219, a sound system 220, a communication interface (I/F) 221, and a universal serial bus (USB) interface (I/F) 230.

The RAM 207, the ROM 208, the CPU 209, the external storage device 215, the detection circuit 211, the display circuit 213, the MIDI interface 216, the music source circuit 218, the effect circuit 219, the communication interface 221, and the USB interface 230 are connected to the bus 206.

The RAM 207 has a buffer area and a working area of the CPU 209 in which flags, registers, a variety of parameters, and the like are stored.

A variety of parameters, a variety of data, a control program, a utility program for implementing this embodiment, or the like can be stored in the ROM 208. In this case, it is not necessary to repeatedly store the programs or the like in the external storage device 215. The ROM 208 may include a rewritable flash memory or the like as well as a conventional read only memory.

The CPU 209 performs calculation or control according to the control program or the like stored in the ROM 208 or the external storage device 215. The timer 210 is connected to the CPU 209 to provide a basic clock signal; interrupt process timing, or the like to the CPU 209.

The user can perform a variety of inputs and settings using the setting operator 212 connected to the detection circuit 211. The setting operator 212 may be any one provided that it can output a signal corresponding to an input from the user, examples of which include a switch, a pad, a fader, a slider, a keyboard for text input, a mouse, a rotary encoder, a joystick, and a jog shuttle. The setting operator 212 may also be a software switch displayed on the display 214 which is operated using another operator such as a mouse.

The performance operator 222 is connected to the detection circuit 211 to provide performance information according to a performance operation of the user. A pad or keyboard for performance may be used as the performance operator 222. The performance operator 222 is not limited to the pad or keyboard and may also be any one provided that the user can input performance information through it.

The display circuit 213 is connected to the display 214 to display a variety of information on the display 214. The user performs a variety of inputs and settings with reference to the information displayed on the displayer 214.

The external storage device 215 includes an external storage device interface through which it is connected to the bus 216. Examples of the external storage device 215 include a flexible disk or floppy (registered trademark) disk drive (FDD), a hard disk drive (HDD), a magneto-optical disc (MO) drive, a compact disc read only memory (CD-ROM) drive, a digital versatile disc (DVD) drive, and a semiconductor memory.

If a hard disk drive (HDD) is connected as the external storage device 215, the control program, the utility program for implementing this embodiment, or the like can be stored in a hard disk in the external storage device 215. By reading the control program or the like from the hard disc into the RAM 207, it is possible to cause the CPU 209 to perform the same operations as those when the control program or the like is stored in the ROM 208. This makes it easy to add a control program or update the version of the control program.

If a CD-ROM drive is connected in addition to the hard disk drive, the control program, the utility program for implementing this embodiment, or the like can be stored in a CD-ROM which is a kind of the machine readable medium. It is possible to copy the control program, the program for implementing this embodiment, or the like to a hard disk. This makes it easy to install a new control program or update the version of the control program.

The MIDI interface (MIDI I/F) 216 can be connected to MIDI equipment 217, a different type of musical instrument, audio equipment, a computer, or the like and can transmit at least MIDI signals. The MIDI interface 216 is not limited to a dedicated MIDI interface and may use a general-purpose interface such as an RS-232C or IEEE (pronounced "I triple E") 1394 interface. In this case, the MIDI interface 16 may be designed to transmit or receive both a MIDI message and other data at the same time. The USB interface 230 may also be used as the MIDI interface 216.

The MIDI equipment 217 is audio equipment, a musical instrument, and the like connected to the MIDI interface 216. The MIDI equipment 217 is not limited to such types of devices and may also be of a different type such as a string instrument type, a wind instrument type, or a percussion instrument type. A tone generator device, an automatic playing device, and the like are not necessarily incorporated into one electronic musical instrument body and may also be separated devices which are connected to each other using a communication scheme such as MIDI or one of a variety of networks.

The tone generator circuit 218 generates a musical sound signal according to performance data or accompaniment pattern data stored in the external storage device 215, the ROM 208, the RAM 207, or the like or a MIDI signal or a performance signal provided from the performance operator 222 or the MIDI equipment 217 connected to the MIDI interface 216. The tone generator circuit 218 then provides the generated musical sound signal to the sound system 220 through the effect circuit 219.

The effect circuit 219 imparts a variety of musical effects to the musical sound signal provided from the tone generator circuit 218. The sound system 220 includes a D/A converter and a speaker and converts the received musical sound signal of digital format into an analog format to generate sound.

The communication interface 221 can be connected to a variety of servers, another electronic musical instrument, a computer, or the like through a communication network 203 such as a local area network (LAN) or the Internet.

Each of the communication interface 221 and the communication network 203 is not limited to a wired type and may also be of a wireless type. The communication interface 221 may be incorporated into the electronic musical instrument 200 and may also be a detachable one such as a PC card or a USB network adapter.

The USB interface 230 is an interface based on the USB standard and the PictBridge (registered trademark) standard. The electronic musical instrument 200 of this embodiment is connected to USB equipment (USB host) 231 through the USB interface 230 via a USB cable so that it functions as a USB device. An example of the USB equipment (USB host) 231 includes a printer based on the PictBridge (registered trademark) standard or a personal computer (PC) including a USB interface. The printer based on the PictBridge (registered trademark) includes a USB interface and a controller for the PictBridge and functions as a USB host.

The USB interface 230 has an actuator that includes a USB physical layer, a PTB transport layer, a DPS layer, and a DPS application layer that are specified in the PictBridge (registered trademark).

Figure 23:
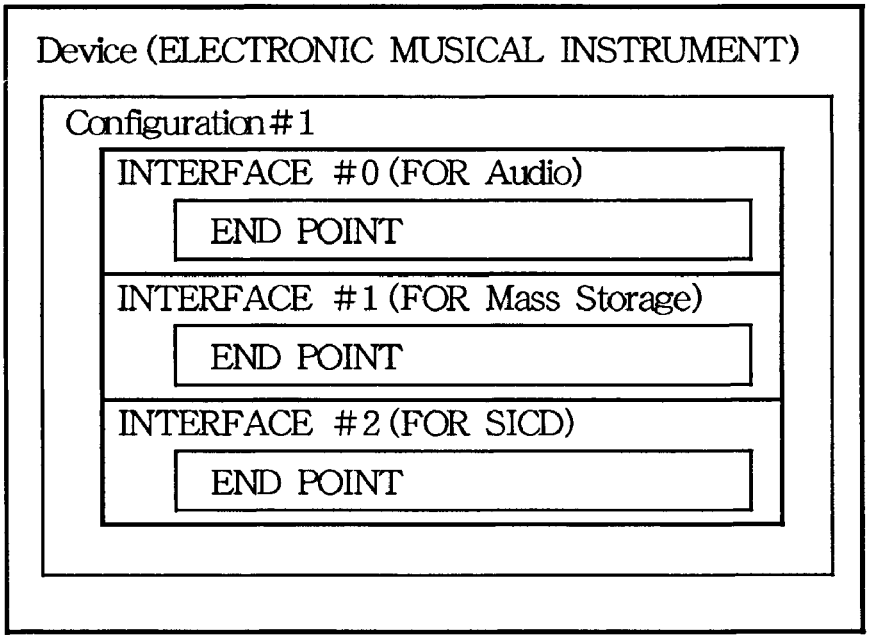
FIG. 23 is a conceptual diagram of descriptors of the USB interface of the electronic musical instrument.

FIG. 23 is a conceptual diagram of descriptors of the USB interface 230 of the electronic musical instrument 200.

The descriptors of the USB interface 230 include, for example, a device descriptor, a configuration descriptor, an interface descriptor, and an endpoint descriptor.

The device descriptor includes the version, the vender ID, the product ID, and the like of the USB interface 230 of the electronic musical instrument 200. The configuration descriptor includes the number of interfaces and the like. In this embodiment, the configuration descriptor includes 3 interfaces #0 to #2 as Configuration #1.

Figure 24:
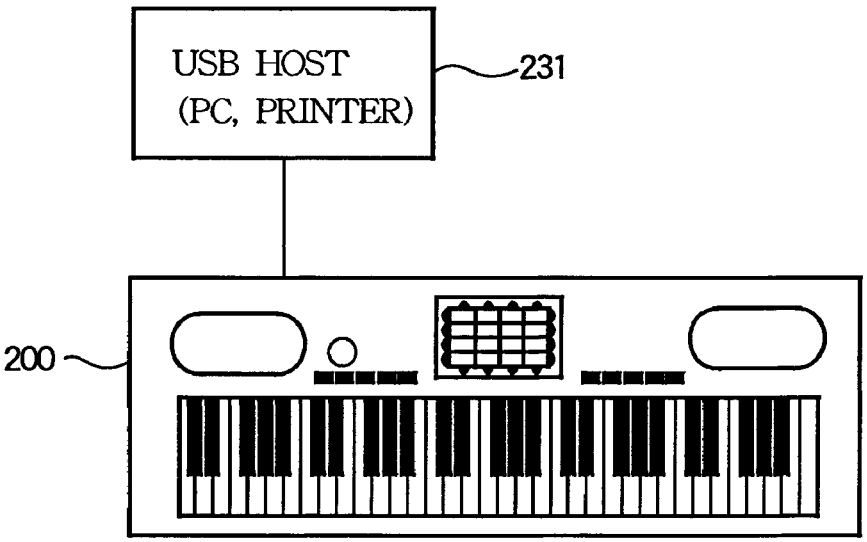
FIG. 24 is a conceptual diagram illustrating connection between the electronic musical instrument and the USB host according to the embodiment of the present invention.

In this embodiment, the interface #0 is an interface for audio. For example, if a USB host 231 shown in FIG. 24 is a computer, the electronic musical instrument 200 functions as an audio device and generates and outputs a musical sound based on automatic playing data received from the computer.

The interface #1 is an interface for mass storage. For example if the USB host 231 shown in FIG. 24 is a computer, the electronic musical instrument 200 functions as an external storage device and the file system of the computer can handle content on the electronic musical instrument 200 as a file.

The interface #2 is an interface for a still image capture device (SICD). For example if the USB host 231 shown in FIG. 24 is a printer, the printer can print image data from the electronic musical instrument 200. Also in this case, the electronic musical instrument 200 and the printer (USB host) 231 are connected to each other through a USB cable without involving another device such as a computer and the printer can print image data provided from the electronic musical instrument 200. If the electronic musical instrument 200 and the printer (USB host) 231 are connected through the interface #2, the electronic musical instrument 200 functions as a storage server and a printer client and the printer (USB host) 231 functions as a storage client and a print server.

One or more end points are set for each of the interfaces. The endpoint descriptor includes a transmission type (transmission direction), a maximum packet length that can be used for transmission, a transmission interval, and the like of each endpoint.

Figure 25:
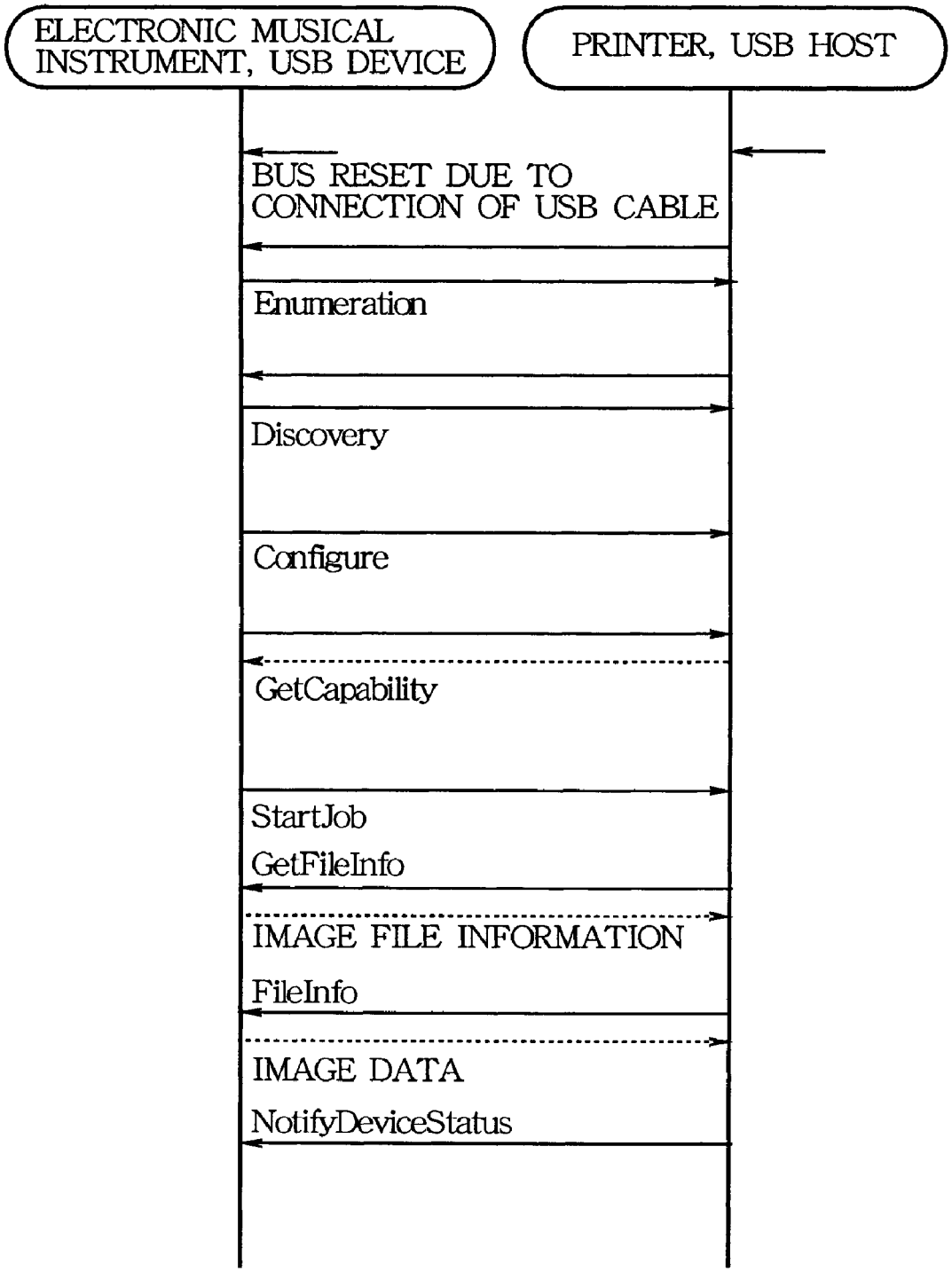
FIG. 25 is a conceptual diagram illustrating a system flow between the electronic musical instrument and the printer (USB host) according to the embodiment.

FIG. 25 is a conceptual diagram illustrating a system flow between the electronic musical instrument 200 and the printer (USB host) 231 according to this embodiment.

First, a USB cable is connected to both the electronic musical instrument (USB device) 200 and the printer (USB host) 231, which causes the bus to be reset. Thereafter, the electronic musical instrument 200 transmits, for example, the descriptor shown in FIG. 24 to the printer 231 according to a request from the printer 231 (Enumeration). This establishes a connection between the electronic musical instrument 200 and the printer 231 through the USB interface 230. Thereafter, each of the electronic musical instrument 200 and the printer 231 checks whether or not each other is a device having a digital photo solutions (DPS) function (Discovery).

Then, each of the electronic musical instrument 200 and the printer 231 checks which functions each other has (Configure). In this embodiment, it is assumed that the printer 231 prints image data (see FIG. 27) created by the electronic musical instrument 200. Thus, the electronic musical instrument 200 as a print client requests that the printer 231 provide a print server function and notifies the printer 231 that it has a storage server function. The printer 231 notifies the electronic musical instrument 200 that it can provide a print server function and that, as a storage client, it uses the storage server function of the electronic musical instrument 200.

Then, the electronic musical instrument 200 queries the printer 231 about its settable capabilities (GetCapability). Here, for example, the electronic musical instrument 200 inquires about formats of image data printable by the printer 231 such as bitmap format, JPEG format, etc. By performing this process, the electronic musical instrument 200 can afterwards control print functions of the printer 231 (for example, to cause it to start printing).

Then, as the user performs a print start operation of the electronic musical instrument 200, the electronic musical instrument transmits a variety of print setting information to the printer 231 while requesting it to start printing (Startjob). Upon receiving the print start request, the printer 231 requests that the electronic musical instrument 200 provide information (image file information) required for printing such as the size of an image file (GetFileInfo). Then, the electronic musical instrument 200 transmits image file information to the printer 231.

Based on the received image file information, the printer 231 requests the image file for printing from the electronic musical instrument 200 (GetFile) and then reads its image data and performs actual printing of the image data. After the printing is completed, the printer 231 finally notifies the electronic musical instrument 200 of the printing result (NotifyDeviceStatus).

Although the first printing after the connection through the USB cable is performed by sequentially performing all the processes of the above-described sequence, the subsequent printings are each performed by repeating the sequence from the StartJob process to the Notify process.

Figure 26:
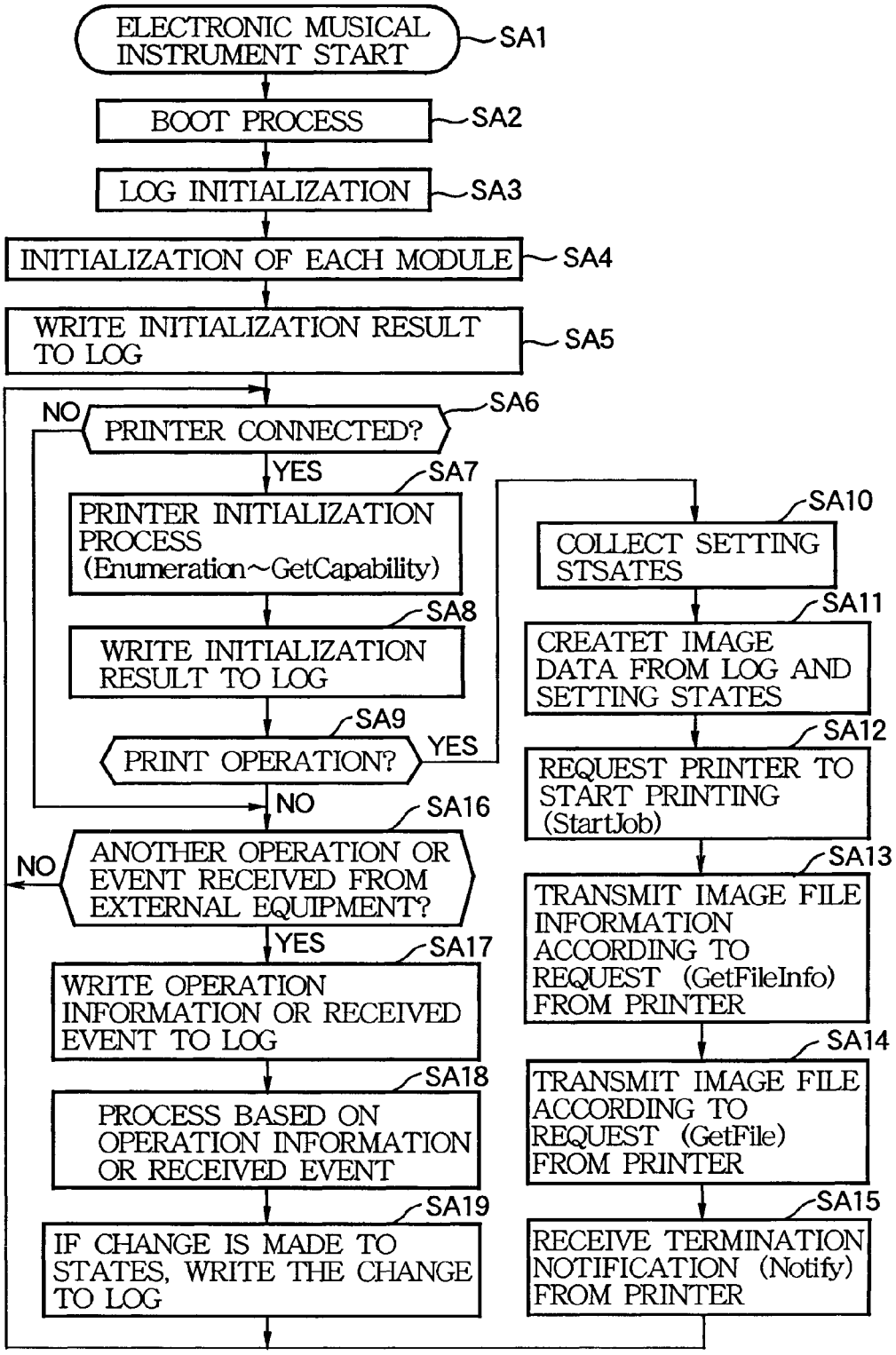
FIG. 26 is a flow chart of a procedure for the electronic musical instrument according to the embodiment.

FIG. 26 is a flow chart of a procedure for the electronic musical instrument 200. This procedure is initiated by powering on the electronic musical instrument 200 and is terminated by powering it off.

The procedure for the electronic musical instrument 200 is initiated at step SA1 and its boot process is performed at step SA2. In the boot process, the CPU 209 in FIG. 22 accesses the ROM 208 and the RAM 207 to make programs executable.

At step SA3, the CPU 209 initializes a log including records of an operation history, a state transition history, and the like. Here, for example, the CPU 209 secures a log storage area on the RAM 207 and deletes data on the area. Thereafter, the CPU 209 places a write pointer at a head of the log area and resets the index.

At step SA4, the CPU 209 initializes each module. Here, the CPU 209 initializes drivers of the external storage device 215, the detection circuit 211, the display circuit 213, the MIDI interface 216, the tone generator circuit 218, the effect circuit 219, the communication interface 221, the USB interface 230, and the like shown in FIG. 22 or initializes settings in the work area for performing normal performance processes.

At step SA5, the CPU 209 records the initialization results of the modules obtained at step SA4 in the log storage area in the RAM 207 secured at step SA3. Here, the CPU 209 advances the write pointer and adds "1" to the index each time writing to the log is done. In the case where the secured log storage area is not large enough, the CPU 209 may terminate storing the log upon termination of the storage area and may return the write pointer to the head and then may sequentially overwrite old log elements, starting from the oldest element, with new ones.

The CPU 209 checks, at step SA6, whether or not the printer is connected. If the printer 231 is connected to the USB interface 230, the CPU 209 proceeds to step SA7 indicated by a YES arrow. If the printer 231 is not connected, the CPU 209 proceeds to step SA16 indicated by a NO arrow.

At step SA7, the CPU 209 performs a printer initialization procedure from Enumeration to GetCapability processes shown in FIG. 25. At step SA8, the CPU 209 stores the result of the printer initialization process of step SA7 in the log storage area in the RAM 207 secured at step SA3. Here, the CPU 209 advances the write pointer and adds "1" to the index each time writing to the log is done in the same manner as the process of step SA5.

If the printer has already been connected and thus the procedure from steps SA6 to SA8 has been performed once, then the procedure from steps SA6 to SA8 is omitted in the second and subsequent rounds of the routine.

At step SA9, the CPU 209 checks whether or not the user has performed a print operation. If the user has performed a print operation (has made a print start request), the CPU 209 proceeds to step SA10 indicated by a YES arrow. If the user has performed no print operation, the CPU 209 proceeds to step SA16 indicated by a NO arrow. The user performs the print operation for example by depressing a print switch (setting operator) 212 mounted on an operating panel of the electronic musical instrument 200. Here, the screen of the display 214 may be switched to a print setting page and the user may issue a print instruction by operating the setting operator 212 or a software switch, a touch panel, or the like.

At step SA10, the CPU 209 collects current setting states of the electronic musical instrument 200. These collected setting states include all setting values that can be set at the electronic musical instrument 200, examples of which include volume, tone, tempo, settings of a variety of effects, MIDI interface settings, and keyboard settings (velocity, after-touch, etc.).

At step SA11, the CPU 209 creates, for example, an image data file shown in FIG. 27 based on both the log information (in the log storage area in the RAM 207 secured at step SA3) and the setting states collected at step SA10. The format of the created image data file is one of the file formats printable by the printer 231 which are obtained in the printer initialization process ("GetCapability" in FIG. 25) of step SA7. The electronic musical instrument 200 creates the image data file using a font embedded in it. The image data is created using a method that is based on known technologies.

As shown in FIG. 27, the image data file created in this process includes, for example, a log, in which internal state transitions in the initialization upon the startup (indices 0001-0002) recorded at step SA5, internal state transitions in the printer initialization process (indices 0204-0205) recorded at step SA8, a record of reception of performance events from external equipment (indices 3728-3729) and a record of operations of the performance operator (indices 3728-3731) recorded at step SA17 which will be described later, a record of operations of the setting operator (index 4474), and state transitions (index 4476) according to operations recorded at step SA19 which will be described later are listed in chronological order, and current setting states of the electronic musical instrument 200.

At step SA12, as the user performs a print start operation of the electronic musical instrument 200, the CPU 209 transmits a variety of print setting information to the printer 231 while requesting the printer 231 to start printing ("StartJob" in FIG. 25).

At step SA13, the CPU 209 receives a request for information (image file information) such as the size of the image file, which is required for the printing, from the printer 231 ("GetFileInfo" in FIG. 25) and transmits the image file information of the image data created at step SA11 to the printer 231.

At step S14, the CPU 209 receives a request for the image file (image data) to be printed from the printer 231 ("GetFile" in FIG. 25) and transmits the image data created at step SA11 to the printer 231.

At step SA15, the CPU 209 receives a print notification (Notify) from the printer 231 ("NotifyDeviceStatus" in FIG. 25). Thereafter, the CPU 209 returns to step SA6 and repeats the subsequent processes.

At step SA16, the CPU 209 determines whether or not the user has performed a performance operation (an operation of the performance operator 222) or a setting operation (an operation of the setting operator 212) or a performance operation event or a setting operation event has been received from external equipment. If the user has performed a performance operation (an operation of the performance operator 222) or a setting operation (an operation of the setting operator 212) or a performance operation event or a setting operation event has been received from external equipment, the CPU 209 proceeds to step SA17 indicated by a YES arrow. Otherwise, the CPU 209 returns to step SA6 indicated by a NO arrow and repeats the subsequent processes.

At step SA17, the CPU 209 stores information of the performance operation (an operation of the performance operator 222) or the setting operation (an operation of the setting operator 212) performed by the user or the performance operation event or the setting operation event received from the external equipment, which are detected at step SA16, in the log storage area in the RAM 207 secured at step SA3. Here, the CPU 209 advances the write pointer and adds "1" to the index each time writing to the log is done in the same manner as the process of step SA5.

The CPU 209 performs a process according to the information of the performance operation (an operation of the performance operator 222) or the setting operation (an operation of the setting operator 212) performed by the user or the performance operation event or the setting operation event received from the external equipment which are detected at step SA16. An example of this process includes a sound generation process based on a performance operation (performance event) or a setting change based on a setting operation (setting event).

At step SA19, if the process of step SA18 has made a change to the setting states of the electronic musical instrument 200, the CPU 209 records the state change in the log storage area in the RAM 207 secured at step SA3. Here, the CPU 209 advances the write pointer and adds "1" to the index each time writing to the log is done in the same manner as the process of step SA5. Thereafter, the CPU 209 returns to step SA6 and repeats the subsequent processes.

In the above embodiment of the invention, the electronic musical instrument 200 and the printer 231 are connected using the standard (for example, the PictBridge (registered trademark) standard) which allows a USB device and a USB host to be connected without involving a computer. Accordingly, print operations of the printer 231 can be controlled from the electronic musical instrument 200 without involving a computer. This ensures that, with the electronic musical instrument 200 alone, it is possible to directly print the log file of the electronic musical instrument 200 through the printer 231. In addition, with the electronic musical instrument 200 alone, it is possible to directly print the setting states of the electronic musical instrument 200 through the printer 231.

When the above configuration is employed, the user can print and view a list of a log and setting states, which cannot be displayed on the display 214 of the electronic musical instrument 200, through the printer 231.

Although all states of the electronic musical instrument 200 are collected and printed in the above embodiment, part of the states of the electronic musical instrument 200 may be collected and printed and, alternatively, all states of the electronic musical instrument 200 may be collected and part of the states may then be printed. In addition, the user may be allowed to select setting states to be collected and also to set items to be printed.

Further, only a part of the log may be printed or only a part of the log selected by the user may be converted into image data and then be printed.

Without being limited to an electronic musical instrument type, the electronic musical instrument 200 may be applied to a camera or game device equipped with a musical instrument. When it is of an electronic musical instrument type, the electronic musical instrument 200 is not limited to a keyboard instrument type and may be of a string instrument type, a wind instrument type, a percussion instrument type, or the like. In addition, a tone generator device, an automatic playing device, and the like are not necessarily incorporated into one electronic musical instrument body and may also be separated devices which are connected to each other using communication means such as a MIDI interface or one of a variety of networks.

Although the present invention has been described with reference to the above embodiments, the invention is not limited to the above embodiments. For example, those skilled in the art will appreciate that a variety of modifications, improvements, combinations, and the like are possible in the invention.

What is claimed is:

1. An electronic musical instrument comprising:

an input device that inputs performance information, wherein the input device includes one or more operators for inputting either of setting operation for setting the electronic musical instrument or performance operation;

a tone generator that generates music sounds according to the performance information and setting parameters, wherein the tone generator generates music sounds in response to the performance operation;

an image data generating part that generates image data representing either of the performance information or the setting parameters;

an interface directly connectable to an external printer for outputting the image data to the external printer;

an acquisition part that acquires an image data format printable by the external printer;

a recording part that records a log, which is at least one of a history of operations of the operators or a transition of the setting state of the electronic musical instrument based on a sequence of setting operations by the operators, the recorded log listing at least internal state transitions upon startup of the electronic musical instrument, internal state transitions in printer initialization process, reception of the performance information from an external equipment, reception of the performance information from an external equipment, reception of setting information and transitions of the setting state of the electronic musical instrument due to the setting information, wherein the image data generating part generates image data representing the recorded log in the acquired image data format; and a print instruction part that transmits the generated image data to the external printer through the interface to print the log according to the generated image data.

2. The electronic musical instrument according to claim 1, further comprising a reception part that receives the performance information for use in the tone generator to generate the music sounds according to the received performance information and that receives the setting information for use in setting of the various parts of the electronic musical instrument from external equipment.

* * * * *